US009494886B2

(12) United States Patent
Kumai et al.

(10) Patent No.: US 9,494,886 B2
(45) Date of Patent: Nov. 15, 2016

(54) TONER, IMAGE FORMING APPARATUS, IMAGE FORMING METHOD, PROCESS CARTRIDGE, AND TWO-COMPONENT DEVELOPER

(71) Applicants: Mio Kumai, Shizuoka (JP); Hideki Sugiura, Shizuoka (JP)

(72) Inventors: Mio Kumai, Shizuoka (JP); Hideki Sugiura, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/421,016

(22) PCT Filed: Aug. 30, 2013

(86) PCT No.: PCT/JP2013/074007
§ 371 (c)(1),
(2) Date: Feb. 11, 2015

(87) PCT Pub. No.: WO2014/034963
PCT Pub. Date: Mar. 6, 2014

(65) Prior Publication Data

US 2015/0234302 A1 Aug. 20, 2015

(30) Foreign Application Priority Data

Sep. 3, 2012 (JP) ..... 2012-192858

(51) Int. Cl.
*G03G 9/087* (2006.01)
*G03G 9/08* (2006.01)

(52) U.S. Cl.
CPC ..... *G03G 9/08724* (2013.01); *G03G 9/0825* (2013.01); *G03G 2215/0607* (2013.01)

(58) Field of Classification Search
CPC .... G03G 9/08755; G03G 5/12; G03G 13/20; G03G 9/087
See application file for complete search history.

(56) References Cited

U.S. PATENT DOCUMENTS

2007/0196759 A1 8/2007 Yoshida et al.
2008/0044753 A1 2/2008 Hirota
2008/0050669 A1* 2/2008 Ohmura ..... G03G 9/08755 430/109.4
2008/0081273 A1* 4/2008 Murakami ..... G03G 9/0821 430/48
2008/0102395 A1* 5/2008 Ohmura ..... G03G 9/08755 430/109.4
2008/0199233 A1 8/2008 Matsunaka et al.
2009/0029277 A1 1/2009 Okuda et al.

(Continued)

FOREIGN PATENT DOCUMENTS

EP 1 783 559 A1 5/2007
JP 04-120555 4/1992

(Continued)

OTHER PUBLICATIONS

Combined Russian Office Action and Search Report issued Oct. 23, 2015 in Patent Application No. 2015112127/28(018968) (with English language translation).

(Continued)

*Primary Examiner* — Hoa V Le
(74) *Attorney, Agent, or Firm* — Oblon, McClelland, Maier & Neustadt, L.L.P.

(57) ABSTRACT

To provide a toner, which contains: a colorant; a resin; and a releasing agent, wherein a spin-spin relaxation time (T2s) originated from a soft component is 0.10 msec to 0.50 msec, where the soft component is obtained with a hard component from an echo signal of the toner by a solid-echo technique of pulsed NMR, and a proportion of a proton intensity of the soft component is 50.0% or lower.

12 Claims, 4 Drawing Sheets

(56) References Cited

U.S. PATENT DOCUMENTS

| | | | | |
|---|---|---|---|---|
| 2010/0189479 | A1 | 7/2010 | Matsunaka et al. | |
| 2011/0065036 | A1* | 3/2011 | Inoue | G03G 9/08755 430/108.2 |
| 2011/0177447 | A1 | 7/2011 | Suzuki et al. | |
| 2011/0200929 | A1* | 8/2011 | Karato | G03G 9/0804 430/108.8 |
| 2011/0281209 | A1 | 11/2011 | Sugiura et al. | |
| 2011/0300478 | A1* | 12/2011 | Sekikawa | G03G 9/08755 430/108.1 |
| 2012/0122027 | A1 | 5/2012 | Watanabe et al. | |
| 2012/0282000 | A1 | 11/2012 | Nakayama et al. | |
| 2013/0078563 | A1 | 3/2013 | Nakayama et al. | |
| 2013/0095422 | A1 | 4/2013 | Yamamoto et al. | |
| 2013/0115550 | A1 | 5/2013 | Amemori et al. | |
| 2013/0177846 | A1 | 7/2013 | Watanabe et al. | |
| 2013/0224648 | A1 | 8/2013 | Honda et al. | |
| 2013/0266897 | A1 | 10/2013 | Aoki et al. | |

FOREIGN PATENT DOCUMENTS

| | | | |
|---|---|---|---|
| JP | 2001-117268 | | 4/2001 |
| JP | 2006-235585 | | 9/2006 |
| JP | 2007-219215 | A | 8/2007 |
| JP | 2007-316273 | A | 12/2007 |
| JP | 2008-052192 | | 3/2008 |
| JP | 2010-085630 | A | 4/2010 |
| JP | 2010-145633 | | 7/2010 |
| JP | 2010-217849 | A | 9/2010 |
| JP | 2011-150043 | | 8/2011 |
| JP | 2011-257738 | | 12/2011 |
| JP | 2012-027212 | | 2/2012 |
| JP | 2012-093562 | | 5/2012 |
| JP | 2012-98697 | A | 5/2012 |
| JP | 2012-118466 | A | 6/2012 |
| JP | 2012-118499 | A | 6/2012 |
| JP | 2012-118504 | A | 6/2012 |
| JP | 2012-133161 | | 7/2012 |
| JP | 2012-133332 | | 7/2012 |
| JP | 2012-141542 | | 7/2012 |
| RU | 2 415 455 | C1 | 3/2011 |
| RU | 2009 139 758 | A | 5/2011 |
| WO | WO 2009/122687 | A1 | 10/2009 |

OTHER PUBLICATIONS

Extended European Search Report issued Sep. 14, 2015 in European Patent Application No. 13832317.5.

Information Offer Form issued Nov. 11, 2014 in Japanese Patent Application No. 2012-192858 (with English language translation).

Office Action issued Jan. 22, 2015 in Japanese Patent Application No. 2012-192858.

International Search Report Issued Oct. 22, 2013 for counterpart International Patent Application No. PCT/JP2013/074007 filed Aug. 30, 2013.

Office Action issued Jun. 17, 2016, in corresponding Korean Patent Application No. 10-2015-7006762 (with English-language Translation).

* cited by examiner

TONER, IMAGE FORMING APPARATUS, IMAGE FORMING METHOD, PROCESS CARTRIDGE, AND TWO-COMPONENT DEVELOPER

TECHNICAL FIELD

The present invention relates to a toner, an image forming apparatus, an image forming method, a process cartridge, and a two-component developer.

BACKGROUND ART

An image forming apparatus, such as an electrophotographic device, and an electrostatic recording device, an image is formed by developing a latent electrostatic image formed on a photoconductor with a toner to form a toner image, transferring the toner image to a recording medium, such as paper, and then fixing the toner image with application of heat. To form a full-color image, typically four colors of the toners, black, yellow, magenta, and cyan, are used for developing, and toner images of these colors are transferred and superimposed on the recording medium, followed by fixing at once with application of heat.

Low temperature fixing has been sought for the purpose of lowering global environmental loads. However, a toner having a low melting point forms aggregates, and forms defective images (especially in a high temperature high humidity environment). Therefore, as a low temperature fixing ability of a toner is improved further, it is very difficult for a conventional toner to attain both low temperature fixing ability and inhibition of aggregation.

For example, there is an attempt to attain both low temperature fixing ability and hot offset resistance by using crystalline polyester in a toner (see PLT 1), but there is no teaching about influence of aggregates of the toner. Moreover, the proposed toner cannot achieve both an ultimate level of low temperature fixing ability of the next generation, and a high level of reduction in aggregation of toner particles in high temperature and high humidity environment, which are aimed in the present invention, and therefore remains a problem.

CITATION LIST

Patent Literature

PTL1: Japanese Patent Application Laid-Open (JP-A) No. 2012-27212

SUMMARY OF INVENTION

Technical Problem

The present invention aims to provide a toner, which can achieve both an ultimate level of low temperature fixing ability, and a high level of reduction in aggregation of toner particles in high temperature and high humidity environment.

Solution to Problem

As means for solving the aforementioned problem, the toner of the present invention contains: a colorant; a resin; and a releasing agent, wherein a spin-spin relaxation time (T2s) originated from a soft component is 0.10 msec to 0.50 msec, where the soft component is obtained with a hard component from an echo signal of the toner by a solid-echo technique of pulsed NMR, and a proportion of a proton intensity of the soft component is 50.0% or lower.

Advantageous Effects of Invention

The present invention can provide a toner, which can achieve both an ultimate level of low temperature fixing ability, and a high level of reduction in aggregation of toner particles in high temperature and high humidity environment.

DESCRIPTION OF EMBODIMENTS

Figure 1:
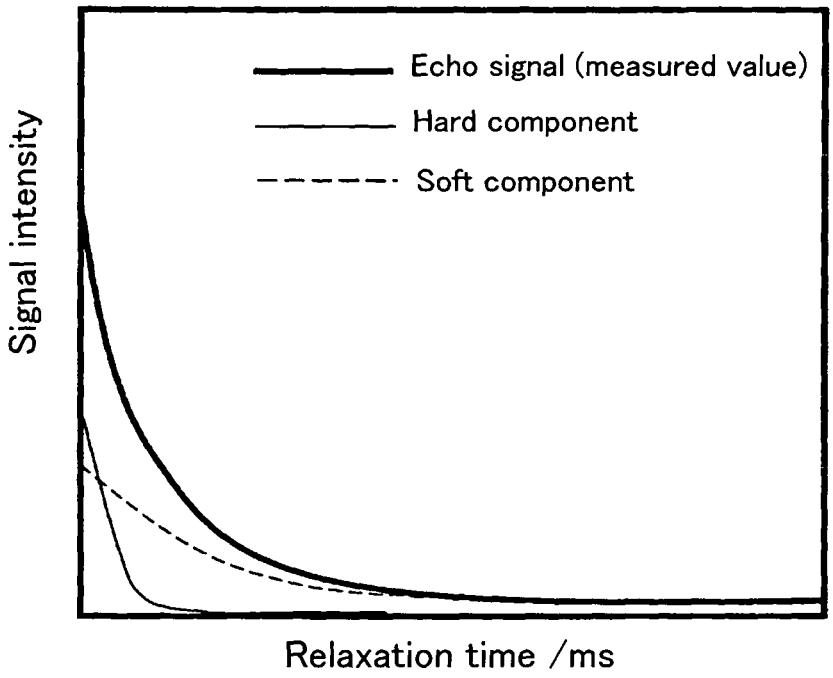
FIG. 1 is a diagram depicting three relaxation curves, including an example a relaxation curve of an echo signal, and those of a hard component and a soft component obtained by decomposing the echo signal.

The present invention will be described in detail, hereinafter. Here, as for the general systems of the toner, production method or material of the developer, and the electrophotographic process for use in the present invention, any of those known in the art can be used, as long as they satisfy the conditions specified in the present invention.

(Toner)

The toner of the present invention contains at least a colorant, a resin, and a releasing agent, and may further contain other components, if necessary.

The mechanism of the present invention is currently investigated, but the following insight has been attained from some analysis data.

The toner of the present invention contains a colorant, a resin, and a releasing agent, wherein a spin-spin relaxation time (T2s) originated from a soft component is 0.10 msec to 0.50 msec, preferably 0.20 msec to 0.50 msec, more preferably 0.30 msec to 0.50 msec, where the soft component is obtained with a hard component from an echo signal of the toner by a solid-echo technique of pulsed NMR, and a proportion of a proton intensity of the soft component is 50.0% or lower, more preferably 25.0% or lower.

The toner achieves both an ultimate level of low temperature fixing ability, and a high level of reduction in aggregation (particularly in high temperature high humidity environment), and use of this toner realizes to provide an image forming apparatus, process cartridge, and developer, which maintain responsiveness to high speed printing.

First, the spin-spin relaxation time ($T_{2s}$) originated from the soft component is a characteristic value to which the thermal behavior of the toner is additionally considered.

In the case where an echo signal obtained by measuring the toner by a solid-echo technique of pulsed NMR is separated into two curves respectively originated a hard component, and a soft component constituting the toner, the spin-spin relaxation time obtained from a curve originated from the soft component is determined as $T_{2s}$. The spin-spin relaxation time ($T_{2s}$) indicates the mobility of molecules constituting the toner, and therefore a melted state of the toner at certain temperature can be evaluated. For example, molecules constituting a toner having low melting point have high mobility even at low temperature, and thus they have long spin-spin relaxation time ($T_{2s}$). In the present invention, as for one of methods for varying spin-spin relaxation time ($T_{2s}$), there is a method for varying an amount of a sharp-melt crystalline resin. As the larger amount of the sharp-melt crystalline resin is contained, a melting point of the toner as a whole becomes low. As a result, molecular mobility at certain temperature becomes high, and therefore the spin-spin relaxation time ($T_{2s}$) becomes long. When the spin-spin relaxation time ($T_{2s}$) is shorter than 0.10 msec, the toner cannot be sufficiently melted at low temperature and therefore the toner is difficult to be compatible with a member to be fixed (e.g., paper), and the fixing ability thereof is not desirable. When the spin-spin relaxation time ($T_{2s}$) is longer than 0.50 msec, on the other hand, the toner is sufficiently melted even at low temperature, but the melted toner is deposited on a fixing roller, which becomes a factor for causing hot offset. Therefore, it is not preferable.

Next, the proportion of a proton intensity of the soft component is a characteristic value representing hardness of the toner.

The proportion of a proton intensity of the soft component is defined as a value, $I_S/(I_H+I_S)\times 100$, using the proton intensity ($I_H$) of the hard component, and the proton intensity ($I_S$) of the soft component obtained by the solid-echo technique. In the present invention, as for one of methods for varying the proportion of the proton intensity of the soft component, there is a method for varying an amount of a crosslinking component of a resin. The amount of the crosslinking component is one of factors for deciding the hardness of the toner. As the amount of the crosslinking component is greater, the resulting toner is harder, and a proportion of the soft component is lower. When the proportion of the proton intensity of the soft component is greater than 50.0%, the hardness of the toner is low, and toner particles are aggregated to each other (especially in a high temperature high humidity environment). Therefore, it is not preferable.

The toner preferably satisfies the following relational expressions (1), more preferably the following relational expressions (2), where T1 is the maximum endothermic peak during first heating from 0° C. to 100° C. as measured by DSC, and T2 is the maximum exothermic peak during cooling as measured by DSC. When the toner satisfies these expressions, it is preferable because an effect of lowing a melting point of the toner, and elevating a setting point thereof can be attained, and low temperature fixing can be performed without forming roller marks.

$$T1-T2\leq 30.0^\circ\text{ C., and } T2\geq 30.0^\circ\text{ C.} \quad (1)$$

$$T1-T2\leq 38.0^\circ\text{ C., and } T2\geq 25.0^\circ\text{ C.} \quad (2)$$

When the maximum endothermic peak temperature of the toner measured from the second heating from 0° C. to 100° C. by DSC is 50° C. or higher, the blocking of the toner does not occur even in a high temperature environment, and therefore it is preferable. When the maximum endothermic peak temperature of the toner measured from the second heating from 0° C. to 100° C. by DSC is 70° C. or lower, it is preferably because low temperature fixing can be achieved. Moreover, the amount of heat of melting in the second heating is preferably 30.0 J/g or greater, more preferably 45.0 J/g or greater, because segments having crystalline structures increase in the toner, which enhance sharp melting, and realizes low temperature fixing. Furthermore, the amount of heat of melting in the second heating is preferably 75.0 J/g or less, as energy required for fixing is reduced, and deterioration in the fixing ability can be prevented.

Moreover, the toner is preferably a toner having a core-shell structure, as the toner can maintain hardness thereof, and can reduce a difference in a charged amount between toner particles of different colors.

Moreover, it is preferred that a ratio of the tetrahydrofuran (THF) soluble component having a molecular weight of 100,000 or greater be 5% or more, and the weight average molecular weight (Mw) be 20,000 to 70,000, as the viscoelasticity of the toner after being melted can be desirably controlled, and the toner can be fixed at constant temperature and speed regardless of a type of paper used.

Moreover, the resin constituting the toner preferably contains at least a crystalline polyester resin, as freedom in designating low temperature fixing is increased, and it is possible to control shapes of particles, which affect aggregations of toner particles, and it is possible to reduce aggregation of the toner particles (especially in high temperature high humidity environment).

The crystalline polyester resin preferably contains a urethane bond and/or urea bond, as high hardness is provided while maintaining crystallinity as a resin.

Moreover, in an image forming apparatus containing a fixing device configured to fix a visible image using the toner on a recording medium with heat and pressure, a tandem developing system, where at least four developing units each using a different developing color are tandemly aligned, is employed, a system speed is 200 mm/sec to 3,000 mm/sec, a contact pressure of a fixing medium is 10 N/cm$^2$ to 3,000 N/cm$^2$, and fixing nip time is 30 msec to 400 msec. As a result of this, it is possible to provide a color image forming apparatus, in which flowability of the toner is appropriately secured even in the region of the high system speed, developing, transferring, and fixing of the toner can be performed, and deformation of the toner, and melt-fixing of the toner to a fixing medium (e.g., paper) can be appropriately controlled under the high pressure, and at the same time, fixing properties that do not cause hot offset can be attained. In addition, by appropriately controlling the fixing nip time, it is possible to provide a color image forming apparatus, which can appropriately control the heat value required for fixing the toner, has low power consumption, and can secure appropriate image quality.

Moreover, the image forming method using the image forming apparatus can be provided.

Furthermore, it is possible to provide a process cartridge, which contains a latent image bearing member and at least a developing unit that are integratedly supported, can be detachably mounted in a main body of the image forming apparatus, and contains the toner.

Moreover, a two-component developer containing the toner and at least a magnetic carrier, so that it is possible to provide the two-component developer, in which flowability of the toner is appropriately secured, with which appropriate developing and transferring can be performed, and which has high environmental stability (reliability).

<Pulsed NMR>

In the present invention, physical properties of the toner are specified by the results of pulsed NMR (evaluations of spin-spin relaxation time ($T_{2S}$) and a proportion of a proton intensity of a soft component). Pulsed NMR of the toner is preferably performed in the following method.

The evaluations are performed by means of pulsed NMR, Minispec mq series, manufactured by Bruker Japan Co., Ltd. A high frequency magnetic field is applied to the toner inside the NMR tube, as a pulse, to thereby incline the magnetic vector, and mobility of molecules constituting the toner is evaluated from the time until x, and y components of the vector disappear (=relaxation time).

1) Sample

A toner (40 mg) is weighted and sampled in an NMR tube having a diameter of 10 mm, and then is used for a measurement.

2) Measuring Conditions

First 90° Pulse Separation: 0.01 msec

Final Pulse Separation: 2.0 msec

Number of Data Point for Fitting: 20 points

Cumulated number: 32 times

Temperature: 40° C.

3) Calculation Method of Proton Intensity and Spin-Spin Relaxation Time

An echo signal obtained by pulsed NMR is a curve in which easement curves originated from two components, i.e., a hard component having low molecular mobility, and a soft component having high molecular mobility, are overlapped. The obtained echo signal is separated into two easement curve respectively originated from two components by using Bi-exponential approximation of ORIGIN8.5 (produced by OriginLab Corporation), and a proton intensity and spin-spin relaxation time of each component can be calculated. FIG. 1 depicts three easement curves, including an example of an echo signal, and easement curves of a hard component and soft component obtained by separating from the echo signal. The hard component whose molecular mobility is low is typically a component originated from hard materials, such as a crosslinking component of a resin, and the soft component whose molecular mobility is high is originated from soft materials. It has been known that the spin-spin relaxation time is shorter, as the molecular mobility is lower, and it is longer, as the molecular mobility is higher. Among the two separated easement curves, therefore, the easement curve having the shorter spin-spin relaxation time is a hard component, and the easement curve having the longer spin-spin relaxation time is a soft component.

<DSC>

In the present invention, the maximum endothermic peak, maximum exothermic peak, and amount of heat of melting of the toner can be measured by means of a DSC system Q-200 (manufactured by TA Instruments Japan Inc.). First, an aluminum sample container charged with about 5.0 mg of a resin is placed on a holder unit, and the holder unit is then set in an electric furnace. Next, the resin is heated from 0° C. to 100° C. at the heating rate of 10° C./min in a nitrogen atmosphere, followed by being cooled from 100° C. to 0° C. at the cooling rate of 10° C./min. Thereafter, the resin is heated again from 0° C. to 100° C. at the heating rate of 10° C./min, to thereby measure endothermal and exothermal change. The DSC curve for the first heating is selected from the obtained DSC curve by means of an analysis program stored in the DSC system Q-200 (manufactured by TA Instruments Japan Inc.), to thereby measure the maximum endothermic peak temperature T1 of the first heating. Similarly, the maximum exothermic peak temperature T2 during the cooling was measured. Moreover, the DSC curve for the second heating is selected, and the maximum endothermic peak temperature of the second heating was measured. The endothermic value of the endothermic peak having the maximum endothermic peak temperature of the second heating is determined as an amount of heat of melting of the second heating.

<Molecular Weight Distribution and Weight Average Molecular Weight (Mw)>

In the present invention, the molecular weight distribution and the weight average molecular weight (Mw) can be measured by a gel permeation chromatography (GPC) measuring device (e.g., GPC-8220 GPC, manufactured by Tosoh Corporation). As for a column, TSKgel Super HZM-H 15 cm, three-connected column (manufactured by Tosoh Corporation) was used. The resin to be measured is prepared as a 0.15% by mass solution using tetrahydrofuran (THF) (containing stabilizer, manufactured by Wako Chemical Industries, Ltd.). After filtering the solution with a filter having an opening size of 0.2 μm, the filtrate from the filtration is used as a sample. The measurement is performed at temperature of 40° C. by supplying 100 μL of the tetrahydrofuran (THF) sample solution at the flow rate of 0.35 mL/min. For the measurement of the molecular weight of the sample, a molecular weight distribution of the sample is calculated from the relationship between the logarithmic value of the calibration curve prepared from a several monodispersible polystyrene standard samples and the number of counts. As the standard polystyrene samples for preparing the calibration curve, Showdex STANDARD Std. Nos. S-7300, S-210, S-390, S-875, S-1980, S-10.9, S-629, S-3.0, and S-0.580 of SHOWA DENKO K.K., and toluene are used. As the detector, a refractive index (RI) detector is used.

<Resin>

The resin preferably contains at least a crystalline polyester resin.

<<Crystalline Polyester Resin>>

In the present invention, it is preferred that the following crystalline polyester resin be contained.

The melting point of the crystalline polyester resin is preferably in the range of 50° C. to 100° C., more preferably in the range of 55° C. to 90° C., and even more preferably in the range of 55° C. to 85° C. When the melting point thereof is 50° C. or higher, blocking of the stored toner does not occur, and storage stability of the toner or storage stability of the fixed image after fixing becomes excellent. When the melting point thereof is 100° C. or lower, sufficient low temperature fixing ability can be attained. Note that, the melting point of the crystalline polyester resin is determined as peak temperature of an endothermic peak obtained by differential scanning calorimetry (DSC).

In the present invention, the "crystalline polyester resin" means a polymer (copolymer) obtained by polymerizing a component constituting polyester together with another component, as well as a polymer whose constitutional component is of 100% polyester structure. In the former case, however, another constitutional component, other than polyester constituting a polymer (copolymer), is 50% by mass or less.

The crystalline polyester resin for use in the toner of the present invention is synthesized, for example, from a polycarboxylic acid component, and a polyhydric alcohol component. Note that, in the present embodiment, the crystalline polyester resin may be a commercial product selected for use, or may be appropriately synthesized for use.

Examples of the polycarboxylic acid component include: aliphatic dicarboxylic acid, such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid; aromatic dicarboxylic acid, such as dibasic acid (e.g., phthalic acid, isophthalic acid, terephthalic acid, naphthalene-2,6-dicarboxylic acid, malonic acid, and mesaconic acid); and anhydrides thereof and lower alkyl ester thereof. However, the examples are not limited to those listed above.

Examples of the tri or higher polycarboxylic acid include 1,2,4-benzenetricarboxylic acid, 1,2,5-benzenetricarboxylic acid, 1,2,4-naphthalenetricarboxylic acid, anhydrides thereof, and lower alkyl esters thereof. These may be used independently, or in combination.

Moreover, the acid component may contain, other than the aliphatic dicarboxylic acid or aromatic dicarboxylic acid, a dicarboxylic acid component having a sulfonic acid group. Furthermore, the acid component may contain, other than the aliphatic dicarboxylic acid or aromatic dicarboxylic acid, a dicarboxylic acid component having a double bond.

The polyhydric alcohol component is preferably aliphatic diol, more preferably straight-chain aliphatic diol, whose principle chain segment has 7 to 20 carbon atoms. In the case of branched-chain aliphatic diol, crystallinity of a resulting polyester resin is low, which may lower a melting point thereof. When the number of carbon atoms in the principle chain segment is less than 7, moreover, melting temperature is high in the case where it is condensation polymerized with aromatic dicarboxylic acid, and it may be difficult to achieve low temperature fixing ability. When the number thereof is greater than 20, it may be difficult to attain a material for practical use. The number of carbon atoms in the principle chain segment is preferably 14 or less.

Specific examples of the aliphatic diol suitably used for synthesis of the crystalline polyester for use in the present invention include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol, but the examples are not limited those listed above. Among them, 1,8-octanediol, 1,9-nonanediol, and 1,10-decanediol are preferable as they are readily available.

Examples of the trihydric or higher alcohol include glycerin, trimethylol ethane, trimethylol propane, and pentaerythritol. These may be used alone, or in combination.

An amount of the aliphatic diol in the polyhydric alcohol is preferably 80 mol % or greater, more preferably 90 mol % or greater. When the amount of the aliphatic diol is less than 80 mol %, crystallinity of the polyester resin may be low, which reduces the melting temperature. Therefore, the blocking resistance of the toner, image storage stability, and low temperature fixing ability may be degraded.

For the purpose of adjusting an acid value or hydroxyl value, polycarboxylic acid or polyhydric alcohol may be optionally added at the final stage of synthesis. Examples of the polycarboxylic acid include: aromatic carboxylic acid, such as terephthalic acid, isophthalic acid, phthalic anhydride, trimellitic anhydride, pyromellitic acid, and naphthalene dicarboxylic acid; aliphatic carboxylic acid, such as maleic anhydride, fumaric acid, succinic acid, alkenyl succinic anhydride, adipic acid; and alicyclic carboxylic acid, such as cyclohexane dicarboxylic acid.

Examples of the polyhydric alcohol include: aliphatic diol, such as ethylene glycol, diethylene glycol, triethylene glycol, propylene glycol, butanediol, hexanediol, neopentyl glycol, and glycerin; alicyclic diol, such as cyclohexanediol, cyclohexane dimethanol, and hydrogenated bisphenol A; and aromatic diol, such as bisphenol A ethylene oxide adduct, and bisphenol A propylene oxide adduct.

The production of the crystalline polyester resin can be performed at the polymerization temperature of 180° C. to 230° C. Optionally, the polymerization reaction is carried out with removing water or alcohol generated during condensation by reducing the pressure inside the system.

In the case where a polymerizable monomer is not dissolved or does not become compatible at the reaction temperature, the polymerizable monomer may be dissolved by adding a solvent having a high boiling point or a solubilizing agent. The polycondensation reaction is carried out while removing the solubilizing agent. In the case where there is a polymerizable monomer having poor compatibility in the copolymerization reaction, the polymerizable monomer having poor compatibility may be condensed with the polymerizable monomer, and acid or alcohol to be polycondensed in advance, and the resultant may be polycondensed with a main component.

The catalyst usable in the synthesis of the crystalline polyester resin includes: an alkali metal compound such as sodium, and lithium; an alkali earth metal compound such as magnesium, and calcium; a metal compound such as zinc, manganese, antimony, titanium, tin, zirconium, and germanium; and others such as a phosphorous acid compound, a phosphoric acid, and an amine compound.

Specific examples thereof include compounds such as sodium acetate, sodium carbonate, lithium acetate, lithium carbonate, calcium acetate, calcium stearate, magnesium acetate, zinc acetate, zinc stearate, zinc naphthenate, zinc chloride, manganese acetate, manganese naphthenate, titanium tetraethoxide, titanium tetrapropoxide, titanium tetraisopropoxide, titanium tetrabutoxide, antimony trioxide, triphenyl antimony, tributyl antimony, tin formate, tin oxalate, tetraphenyl tin, dibutyl tin dichloride, dibutyl tin oxide, diphenyl tin oxide, zirconium tetrabutoxide, zirconium naphthenate, zirconium carbonate, zirconium acetate, zirconium stearate, zirconium octylate, germanium oxide, triphenyl phosphite, tris(2,4-di-t-butylphenyl)phosphite, ethyltriphenyl phosphonium bromide, triethyl amine, and triphenyl amine.

The acid value ((the value (mg) of KOK necessary to neutralize 1 g of the resin) of the crystalline polyester resin for use in the present invention is preferably in the range of 3.0 mgKOH/g to 30.0 mgKOH/g, more preferably in the range of 6.0 mgKOH/g to 25.0 mgKOH/g, and even more preferably 8.0 mgKOH/g to 20.0 mgKOH/g.

When the acid value is lower than 3.0 mgKOH/g, dispersibility thereof in water is low, and therefore it may be very difficult to produce particles by a wet production method. Moreover, stability as polymerized particles is significantly degraded during aggregation, and therefore it may be difficult to produce a toner efficiently. When the acid value is greater than 30.0 mgKOH/g, on the other hand, moisture uptake thereof as a toner increases, and therefore the toner may be easily influenced from the environment.

Moreover, the weight average molecular weight (Mw) of the crystalline polyester resin is preferably 6,000 to 35,000. When the weight average molecular weight (Mw) thereof is 6,000 or greater, the toner does not sink into a surface of a recording medium, such as paper, during fixing, and therefore uneven fixing does not occur. In addition, the strength or resistance of the toner against bending of the fixed image is not degraded. When the weight average molecular weight (Mw) thereof is 35,000 or less, the viscosity thereof during melting does not became excessively high, and therefore the temperature at which the crystalline polyester resin attains suitable viscosity for fixing is not high. Accordingly, low temperature fixing ability of the resulting toner is not degraded.

The aforementioned weight average molecular weight can be measured by gel permeation chromatography (GPC). The measurement of the molecular weight by GPC is performed using GPC, HLC-8120, manufactured by Tosoh Corporation as a measuring device, a column, TSKgel SuperHM-M (15 cm) manufactured by Tosoh Corporation, and a THF solvent. The weight average molecular weight is calculated from the measurement result using a molecular weight calibration curve prepared from a monodisperse polystyrene standard sample.

An amount of the crystalline polyester resin in the toner is preferable in the range of 10% by mass to 85% by mass. When the amount of the crystalline polyester resin is less than 10% by mass, sufficient low temperature fixing ability may not be attained. When the amount thereof is greater than 85% by mass, sufficient toner strength or fixed image strength may not be attained, and an adverse effect may be provided to electrostatic propensity of the resulting toner.

The aforementioned crystalline resin containing the crystalline polyester resin preferably contains a crystalline polyester resin (may referred to "crystalline aliphatic polyester resin" hereinafter) synthesized using an aliphatic polymerizable monomer as a main component (50% by mass or greater). In this case, moreover, a proportion of the aliphatic polymerizable monomer constituting the crystalline aliphatic polyester resin is preferably 60 mol % or greater, more preferably 90 mol % or greater. As for the aliphatic polymerizable monomer, the aforementioned aliphatic diol or aliphatic acid can be suitably used.

<Urethane Bond and Urea Bond>

The crystalline polyester resin preferably contain a urethane bond and/or a urea bond, as a resulting resin has high hardness, with maintaining crystallinity as a resin.

Use of the crystalline polyester resin is advantageous for enhancing low temperature fixing ability, as the crystalline polyester resin typically has low glass transition temperature. However, the hardness of the crystalline polyester resin has low. By introducing a urethane bond and/or a urea bond into the crystalline polyester, the bond segments act as apparent crosslinking points, and therefore the hardness of the toner is maintained high. The polyester resin containing a urethane bond and/or a urea bond can be synthesized through a reaction between polyester having an isocyanate group at a terminal thereof and diamine.

Examples of the polyester resin containing a urethane bond and/or a urea bond include the following (1) to (10), that are: (1) a mixture containing: polyester prepolymer obtained through a reaction of a polycondensation product between bisphenol A ethylene oxide (2 mol) adduct and isophthalic acid with isophorone diixocyanate, which is subjected to urethanation or ureation with isophorone diamine; and a polycondensation product between bisphenol A ethylene oxide (2 mol) adduct and isophthalic acid, (2) a mixture containing: polyester prepolymer obtained through a reaction of a polycondensation product between a bisphenol A ethylene oxide (2 mol) adduct and isophthalic acid with isophorone diisocyanate, which is subjected to urethanation or ureation with isophorone diamine; and a polycondensation product between bisphenol A ethylene oxide (2 mol) adduct and terephthalic acid, (3) a mixture containing: polyester prepolymer obtained through a reaction of a polycondensation product between bisphenol A ethylene oxide (2 mol) adduct/bisphenol A propylene oxide (2 mol) adduct and terephthalic acid with isophorone diisocyanate, which is subjected to urethanation or ureation with isophorone diamine; and a polycondensation product between bisphenol A ethylene oxide (2 mol) adduct/bisphenol A propylene oxide (2 mol) adduct and terephthalic acid, (4) a mixture containing: polyester prepolymer obtained through a reaction of a polycondensation product between bisphenol A ethylene oxide (2 mol) adduct/bisphenol A propylene oxide (2 mol) adduct and terephthalic acid with isophorone diisocyanate, which is subjected to urethanation or ureation with isophorone diamine; and a polycondensation product between bisphenol A propylene oxide (2 mol) adduct and terephthalic acid, (5) a mixture containing polyester prepolymer obtained through reaction of a polycondensation product between bisphenol A ethylene oxide (2 mol) adduct and terephthalic acid with isophorone diisocyanate, which is subjected to urethanation or ureation with hexamethylene diamine; and a polycondensation product between bisphenol A ethylene oxide (2 mol) adduct and terephthalic acid, (6) a mixture containing: polyester prepolymer obtained through a reaction of a polycondensation product between bisphenol A ethylene oxide (2 mol) adduct and terephthalic acid with isophorone diisocyanate, which is subjected to urethanation or ureation with hexamethylene diamine; and a polycondensation product between bisphenol A ethylene oxide (2 mol) adduct/bisphenol A propylene oxide (2 mol) adduct and terephthalic acid, (7) a mixture containing polyester prepolymer obtained through a reaction of a polycondensation product between bisphenol A ethylene oxide (2 mol) adduct and terephthalic acid with isophorone diisocyanate, which is subjected to urethanation or ureation with ethylene diamine; and a polycondensation product between bisphenol A ethylene oxide (2 mol) adduct and terephthalic acid, (8) a mixture containing: polyester prepolymer obtained through a reaction of a polycondensation product between bisphenol A ethylene oxide (2 mol) adduct and isophthalic acid with diphenylmethane diisocyanate, which is subjected to urethanation or ureation with hexamethylene diamine; and a polycondensation product between bisphenol A ethylene oxide (2 mol) adduct and isophthalic acid, (9) a mixture containing: polyester prepolymer obtained through a reaction of a polycondensation product between bisphenol A ethylene oxide (2 mol) adduct/bisphenol A propylene oxide (2 mol) adduct and terephthalic acid/dodecenyl succinic acid anhydride with diphenylmethane diisocyanate, which is subjected to urethanation or ureation with hexamethylene diamine; and a polycondensation product between bisphenol A ethylene oxide (2 mol) adduct/bisphenol A propylene oxide (2 mol) adduct and terephthalic acid, and (10) a mixture containing: polyester prepolymer obtained through a reaction of a polycondensation product between bisphenol A ethylene oxide (2 mol) adduct and isophthalic acid with toluene diisocyanate, which is subjected to urethanation or ureation with hexamethylene diamine; and a polycondensation product between bisphenol A ethylene oxide (2 mol) adduct and isophthalic acid.

<<Non-Crystalline Polyester Resin>>

In the present invention, the binder resin of the toner preferably contains at least the following non-crystalline polyester resin. As for the non-crystalline polyester resin, there are a modified polyester resin and an unmodified polyester resin. It is more preferred that the binder resin contain both a modified polyester resin and an unmodified polyester resin.

<<Modified Polyester Resin>>

In the present invention, the following modified polyester resin can be used as the polyester resin. For example, polyester prepolymer having an isocyanate group can be used. Examples of the polyester prepolymer (A) having an isocyanate group include a compound obtained by further reacting polyester having an active hydrogen group, which is a polycondensation product of polyol (1) and polycarboxylic acid (2), with polyisocyanate (3). Examples of the active hydrogen group contained in the polyester include a hydroxyl group (e.g., an alcoholic hydroxyl group and a phenolic hydroxyl group), an amino group, a carboxyl group, and a mercapto group. Among them, an alcoholic hydroxyl group is preferable.

Examples of the polyol (1) include diol (1-1), and tri or higher polyol (1-2), and the polyol (1) is preferably (1-1) alone, or a mixture of (1-1) with a small amount of (1-2). Examples of the diol (1-1) include alkylene glycol (e.g., ethylene glycol, 1,2-propylene glycol, 1,3-propylene glycol, 1,4-butanediol, and 1,6-hexanediol); alkylene ether glycol (e.g., diethylene glycol, triethylene glycol, dipropylene glycol, polyethylene glycol, polypropylene glycol, and polytetramethylene ether glycol); alicyclic diol (e.g., 1,4-cyclohexanedimethanol, and hydrogenated bisphenol A); bisphenols (e.g., bisphenol A, bisphenol F, and bisphenol S); alkylene oxide (ethylene oxide, propylene oxide, and butylene oxide) adduct of the alicyclic diol; and alkylene oxide (ethylene oxide, propylene oxide, and butylene oxide) adduct of the bisphenols. Among them, the diol is preferably C2-C12 alkylene glycol, or the alkylene oxide adduct of bisphenols, more preferably the alkylene oxide adduct of bisphenols, or a combination of the alkylene oxide adduct of bisphenols and the C2-C12 alkylene glycol. Examples of the tri or higher polyol (1-2) include tri- to octa- or higher polyhydric aliphatic alcohol (e.g., glycerin, trimethylol ethane, trimethylol propane, pentaerythritol, and sorbitol), tri or higher polyphenol (e.g., trisphenol PA, phenol novolak, and cresol novolak); and alkylene oxide adduct of the tri or higher polyphenol.

Examples of the polycarboxylic acid (2) include dicarboxylic acid (2-1), and tri- or higher polycarboxylic acid (2-2). The polycarboxylic acid (2) is preferably (2-1) alone, or a mixture of (2-1) with a small amount of (2-2). Examples of the dicarboxylic acid (2-1) include alkylene dicarboxylic acid (e.g., succinic acid, adipic acid, and sebacic acid), alkyenylene dicarboxylic acid (e.g., maleic acid, and fumaric acid), and aromatic dicarboxylic acid (e.g., phthalic acid, isophthalic acid, terephthalic acid, and naphthalene dicarboxylic acid). Among them, preferred are C4-C20 alkenylene dicarboxylic acid, and C8-C20 aromatic dicarboxylic acid. Examples of the tri or higher polycarboxylic acid (2-2) include C9-C20 aromatic polycarboxylic acid (e.g., trimellitic acid, and pyromellitic acid). Note that, as for the polycarboxylic acid (2), acid anhydride or lower alkyl ester (e.g., methyl ester, ethyl ester, and isopropyl ester) of the above-listed polycarboxylic acid may be reacted with polyol (1).

A ratio of the polyol (1) to the polycarboxylic acid (2) is determined as an equivalent ratio [OH]/[COOH] of hydroxyl groups [OH] to carboxyl groups [COOH], which is typically 2/1 to 1/1, preferably 1.5/1 to 1/1, and more preferably 1.3/1 to 1.02/1.

Examples of the polyisocyanate (3) include aliphatic polyisocyanate (e.g., tetramethylene diisocyanate, hexamethylene diisocyanate, and 2,6-diisocyanate methyl caproate), alicyclic polyisocyanate (e.g., isophorone diisocyanate, and cyclohexylmethane diisocyanate), aromatic diisocyanate (e.g., tolylene diisocyanate, and diphenyl methane diisocyanate), aromatic aliphatic diisocyanate (e.g., α,α,α',α'-tetramethyl xylylene diisocyanat), isocyanurates, phenol derivatives of the polyisocyanate, the foregoing polyisocyanates blocked with oxime or caprolactam, and any combination of the foregoing polyisocyanates.

A ratio of the polyisocyanate (3) is determined as an equivalent ratio [NCO]/[OH] of isocyanate groups [NCO] to hydroxyl groups [OH] of the polyester having a hydroxyl group, which is typically 5/1 to 1/1, preferably 4/1 to 1.2/1, and more preferably 2.5/1 to 1.5/1.

When the ratio [NCO]/[OH] is greater than 5, low temperature fixing ability is degraded. When the molar ratio of [NCO] is less than 1, a urea content in the modified polyester becomes low, which leads to poor hot offset resistance. An amount of the polyisocyanate (3) constituting component in the prepolymer having an isocyanate at a terminal thereof (A) is typically 0.5% by mass to 40% by mass, preferably 1% by mass to 30% by mass, and even more preferably 2% by mass to 20% by mass. When the amount thereof is less than 0.5% by mass, hot offset resistance is degraded, and moreover it may not be able to realize both heat resistant storage stability and low temperature fixing ability. When the amount thereof is greater than 40% by mass, low temperature fixing ability is degraded.

The average number of isocyanate groups contained in the prepolymer having an isocyanate group (A) per molecule is typically 1 or more, preferably 1.5 to 3, and more preferably 1.8 to 2.5. When the average number thereof is less than 1 per molecule, a molecular weight of modified polyester after crosslinking and/or elongation becomes low, which may degrades hot offset resistance.

<<Unmodified Polyester>>

In the present invention, not only a solo use of the modified polyester (A), an unmodified polyester (C) is preferably contained as a toner binder component together with the modified polyester (A). Use of (C) in combination with (A) can improve glossiness, and gloss uniformity in the case where a resulting toner is used for a low temperature fixing and full-color image forming apparatus. Examples of (C) include a polycondensation product of the polyester component of (A), polyol (1) similar to those listed for use in (A), and polycarboxylic acid (2) similar to those listed for use in (A). Preferable examples thereof are also the same as in (A). Moreover, (C) may be not only the unmodified polyester, but also polyester modified with a chemical bond other than a urea bond, and for example, it may be modified with a urethane bond. It is preferred that (A) and (C) be at least partially compatible to each other in view of low temperature fixing ability and hot offset resistance. Accordingly, the polyester component of (A) and the composition of (C) are preferably similar. In the case where (A) is contained, a mass ratio of (A) to (C) is typically 5/95 to 75/25, preferably 10/90 to 25/75, more preferably 12/88 to 25/75, and particularly preferably 12/88 to 22/78. When the mass ratio of (A) is less than 5%, hot offset resistance may be degraded, and moreover it may not be able to attain both heat resistant storage stability and low temperature fixing ability.

A peak molecular weight of (C) is typically 1,000 to 30,000, preferably 1,500 to 10,000, and more preferably 2,000 to 8,000. When the peak molecular weight thereof is 1,000 or greater, heat resistant storage stability of a resulting toner is not degraded. When the peak molecular weight thereof is 10,000 or less, low temperature fixing ability is not degraded. A hydroxyl value of (C) is preferably 5 mgKOH/g or greater, more preferably 10 mgKOH/g to 120 mgKOH/g, and even more preferably 20 mgKOH/g to 80 mgKOH/g. Use of (C) having the hydroxyl value of 5 mgKOH/g or greater is advantageous for attaining both heat resistant storage stability and low temperature fixing ability. An acid value of (C) is typically 0.5 mgKOH/g to 40 mgKOH/g, preferably 5 mgKOH/g to 35 mgKOH/g. A toner tends to be negatively charged by imparting the acid value to the toner. When the acid value and the hydroxyl value are within the aforementioned ranges, respectively, a resulting toner is hardly influenced by the environment of high temperature high humidity, or low temperature low humidity, and therefore a resulting image is not deteriorated.

In the present invention, glass transition temperature (Tg) of the toner is typically 40° C. to 70° C., preferably 45° C. to 55° C. When it is 40° C. or higher, excellent heat resistant storage stability of a toner can be attained. When it is 70° C. or lower, sufficient low temperature fixing ability of a toner can be attained. As the toner of the present invention contains a cross-linked or elongated polyester resin together with other polyester, the toner of the present invention has excellent storage stability with low glass transition temperature, compared to a conventional polyester-based toner. As for the storage elastic modulus of the toner, the temperature (TG') at which the storage elastic modulus of the toner becomes 10,000 dyne/cm$^2$ with a measuring frequency of 20 Hz is typically 100° C. or higher, more preferably 110° C. to 200° C. When TG' is lower than 100° C., hot offset resistance is impaired. As for the viscosity of the toner, the temperature (Tη) at which the viscosity of the toner becomes 1,000 Poise with a measuring frequency of 20 Hz is typically 180° C. or lower, preferably 90° C. to 160° C. When Tη is higher than 180° C., low temperature fixing ability is impaired. Accordingly, TG' is preferably higher than Tη for attaining both low temperature fixing ability and hot offset resistance. In other words, a difference (TG'−Tη) between TG' and Tη is preferably 0° C. or higher, more preferably 10° C. or higher, and even more preferably 20° C. or higher. The upper limit of the difference is not particularly limited. Moreover, a difference between Tη and Tg is preferably 0° C. to 100° C. in view of attaining both heat resistant storage stability and low temperature fixing ability. The difference between Tη and Tg is more preferably 10° C. to 90° C., and even more preferably 20° C. to 80° C.

<<Vinyl-Based Resin>>

In the present invention, it is preferred that the toner contain the following vinyl-based resin. It is more preferred that the following vinyl-based resin be contained in a binder resin for a shell. The vinyl-based resin is a polymer obtained through homopolymerization or copolymerization of a vinyl-based monomer, and examples thereof include a styrene-(meth)acrylic acid ester resin, a styrene-butadiene copolymer, a (meth)acrylic acid-acrylic acid ester polymer, a styrene-acrylonitrile copolymer, a styrene-maleic anhydride copolymer, and a styrene-(meth)acrylic acid copolymer.

Other than the vinyl-based resin, preferable examples of the non-modified polyester include: a polymer of styrene or substituted product thereof, such as polystyrene, poly-p-chlorostyrene, and polyvinyl toluene; a styrene copolymer, such as styrene-p-chlorostyrene copolymer, styrene-propylene copolymer, styrene-vinyl toluene copolymer, styrene-vinyl naphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, and styrene-maleic acid ester copolymer; and others such as polymethyl methacrylate, and polybutyl methacrylate.

<Colorant>

As for the colorant, any of conventional dyes and pigments can be used. Examples thereof include carbon black, a nigrosin dye, iron black, naphthol yellow S, Hansa yellow (10G, 5G and G), cadmium yellow, yellow iron oxide, yellow ocher, yellow lead, titanium yellow, polyazo yellow, oil yellow, Hansa yellow (GR, A, RN and R), pigment yellow L, benzidine yellow (G and GR), permanent yellow (NCG), vulcan fast yellow (5G, R), tartrazinelake, quinoline yellow lake, anthrasan yellow BGL, isoindolinon yellow, colcothar, red lead, lead vermilion, cadmium red, cadmium mercury red, antimony vermilion, permanent red 4R, parared, fiser red, parachloroorthonitro aniline red, lithol fast scarlet G, brilliant fast scarlet, brilliant carmine BS, permanent red (F2R, F4R, FRL, FRLL and F4RH), fast scarlet VD, vulcan fast rubin B, brilliant scarlet G, lithol rubin GX, permanent red FSR, brilliant carmine 6B, pigment scarlet 3B, Bordeaux 5B, toluidine Maroon, permanent Bordeaux F2K, Helio Bordeaux BL, Bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, Victoria blue lake, metal-free phthalocyanine blue, phthalocyanine blue, fast sky blue, indanthrene blue (RS and BC), indigo, ultramarine, iron blue, anthraquinone blue, fast violet B, methyl violet lake, cobalt purple, manganese violet, dioxane violet, anthraquinone violet, chrome green, zinc green, chromium oxide, viridian, emerald green, pigment green B, naphthol green B, green gold, acid green lake, malachite green lake, phthalocyanine green, anthraquinone green, titanium oxide, zinc flower, lithopone, and a mixture thereof. An amount of the colorant is typically 1% by mass to 15% by mass, and preferably 3% by mass to 10% by mass, relative to the toner.

The colorant for use in the present invention may be used as a master batch in which the colorant forms a composite with a resin. Examples of the binder resin kneaded in the production of, or together with the master batch include, other than the aforementioned modified or unmodified polyester resin, polymer of styrene or substitution thereof (e.g., polystyrene, poly-p-chlorostyrene, and polyvinyl toluene); styrene copolymer (e.g., styrene-p-chlorostyrene copolymer, styrene-propylene copolymer, styrene-vinyl toluene copolymer, styrene-vinyl naphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, and styrene-maleic acid ester copolymer); and others including polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butyral, polyacrylic acid resin, rosin, modified rosin, a terpene resin, an aliphatic or alicyclic hydrocarbon resin, an aromatic petroleum resin, chlorinated paraffin, and paraffin wax. These may be used alone, or in combination.

The master batch can be prepared by mixing by applying high shear force and kneading the colorant with the resin for the master batch. In the mixing and kneading, an organic solvent may be used for improving the interactions between the colorant and the resin. Moreover, the master batch can be prepared by a flashing method in which an aqueous paste containing a colorant is mixed and kneaded with a resin and an organic solvent, and then the colorant is transferred to the resin to remove the water and the organic solvent. This method is preferably used because a wet cake of the colorant is used as it is, and it is not necessary to dry the wet cake of the colorant to prepare a colorant. In the mixing and kneading of the colorant and the resin, a high-shearing disperser (e.g., a three-roll mill) is preferably used.

<Releasing Agent>

As for the releasing agent, common wax can be used. As for the wax, conventional wax can be used. Examples of the wax include: polyolefin wax (e.g., polyethylene wax, and polypropylene wax); long-chain hydrocarbon (e.g., paraffin wax, and Sasol wax); and carbonyl group-containing wax. Among them, preferred is carbonyl group-containing wax. Examples of the carbonyl group-containing wax include: polyalkanoic acid ester (e.g., carnauba wax, montan wax, trimethylol propane tribehenate, pentaerythritol tetrabehenate, pentaerythritol diacetate dibehenate, glycerin tribehenate, and 1,18-octadecanediol distearate); polyalkanol ester (e.g., tristearyl trimellitate, and distearyl meleate); polyalkanoic acid amide (e.g., ethylene diamine dibehenyl amide); polyalknyl amide (e.g., trimellitic acid tristearyl amide); and dialkyl ketone (e.g., distearyl ketone). Among them, preferred is polyalkanoic acid ester. The melting point of the wax for use in the present invention is typically 40° C. to 160° C., preferably 50° C. to 120° C., and more preferably 60° C. to 90° C. The wax having a melting point of lower than 40° C. adversely affects heat resistant storage stability of a toner. The wax having a melting point of higher than 160° C. tends to cause cold offset during fixing performed at low temperature. Moreover, the melt viscosity of the wax is determined as a measured value at temperature higher than the melting point thereof by 20° C., which is preferably 5 cps to 1,000 cps, more preferably 10 cps to 100 cps. The wax having the melt viscosity of higher than 1,000 cps has a poor effect of improving hot offset resistance and low temperature fixing ability. An amount of the wax contained in the toner is typically 0% by mass to 40% by mass, preferably 3% by mass to 30% by mass.

<Other Components>

Examples of the aforementioned other components include a charge controlling agent, external additives, a flow improving agent, a cleaning improving agent, resin particles, and a crosslinking agent and elongation agent.

<<Charge Controlling Agent>>

The toner of the present invention may optionally contain a charge controlling agent. As for the charge controlling agent, any of conventional charge controlling agents can be used. Examples thereof include nigrosine dyes, triphenylmethane dyes, chrome-containing metal complex dyes, molybdic acid chelate pigments, rhodamine dyes, alkoxy amines, quaternary ammonium salts (including fluorine-modified quaternary ammonium salts), alkylamides, phosphorus, phosphorus compounds, tungsten, tungsten compounds, fluorine active agents, metal salts of salicylic acid, and metal salts of salicylic acid derivatives. Specific examples thereof include: nigrosine dye BONTRON 03, quaternary ammonium salt BONTRON P-51, metal-containing azo dye BONTRON S-34, oxynaphthoic acid-based metal complex E-82, salicylic acid-based metal complex E-84 and phenol condensate E-89 (all manufactured by ORIENT CHEMICAL INDUSTRIES CO., LTD); quaternary ammonium salt molybdenum complex TP-302 and TP-415 (all manufactured by Hodogaya Chemical Co., Ltd.); quaternary ammonium salt COPY CHARGE PSY VP 2038, triphenylmethane derivative COPY BLUE PR, quaternary ammonium salt COPY CHARGE NEG VP2036 and COPY CHARGE NX VP434 (all manufactured by Hoechst AG); LRA-901, and boron complex LR-147 (manufactured by Japan Carlit Co., Ltd.); copper phthalocyanine; perylene; quinacridone; azo pigments; and polymeric compounds having, as a functional group, a sulfonic acid group, carboxyl group, and quaternary ammonium salt.

An amount of the charge controlling agent for use in the present invention is determined by a binder resin for use, presence of optionally used additives, and a production method of the toner including a dispersing method, and therefore cannot be determined unconditionally. However, the charge controlling agent is preferably used in an amount ranging from 0.1 parts by mass to 10 parts by mass relative to 100 parts by mass of the binder resin. The amount thereof is preferably in the range of 0.2 parts by mass to 5 parts by mass. When the amount thereof is greater than 10 parts by mass, the electrostatic propensity of the resulting toner is excessively large, and therefore an effect of the charge controlling agent is reduced and electrostatic force to a developing roller increases, which may reduce flowability of the toner, or reduce image density of images formed with the resulting toner. The charge controlling agent may be added by dissolving and dispersing after melting and kneading together with the master batch or the resin, or added by dissolving or dispersing directly in the organic solvent, or added by fixing on a surface of each toner particle after the preparation of the toner particles.

<<External Additives>>

As for external additives for assisting flowability, developing ability and charging ability of colored particles obtained in the present invention, other than oxide particles, inorganic particles or hydrophobic inorganic particles can be used in combination. It is preferred that the external additives contain at least one type of inorganic particles, which have been treated to give hydrophobicity, and have the average primary particle diameter of 1 nm to 100 nm, more preferably 5 nm to 70 nm. It is more preferred that the external additive contain at least one type of inorganic particles, which have been treated to give hydrophobicity, and have the average primary particle diameter of 20 nm or smaller, and at least one type of inorganic particles having the average primary particle diameter of 30 nm or greater. Moreover, the BET specific surface area is preferably 20 $m^2/g$ to 500 $m^2/g$.

As for the external additives, any of conventional additives can be used as long as the conditions are met. For example, the external additives may contain silica particles, hydrophobic silica, fatty acid metal salt (e.g., zinc stearate, and aluminum stearate), metal oxide (e.g., titania, alumina, tin oxide, and antimony oxide), or fluoropolymer.

The particularly preferred additives include hydrophobic silica, titania, titanium oxide, and alumina particles. Examples of the silica particles include: HDK H 2000, HDK H 2000/4, HDK H 2050EP, HVK21, HDK H 1303 (all manufactured by Hoechst GmbH); R972, R974, RX200, RY200, R202, R805, R812 (all manufactured by Nippon Aerosil Co., Ltd.). Examples of the titania particles include: P-25 (manufactured by Nippon Aerosil Co., Ltd.); STT-30, and STT-65 C-S (both manufactured by Titan Kogyo, Ltd.); TAF-140 (manufactured by Fuji Titanium Industry Co., Ltd.); and MT-150W, MT-500B, MT-600B, and MT-150A (all manufactured by TAYCA CORPORATION). Particularly, examples of hydrophobic titanium oxide particles include: T-805 (manufactured by Nippon Aerosil Co., Ltd.); STT-30A, STT-65S-S (both manufactured by Titan Kogyo, Ltd.); TAF-500T, TAF-1500T (both manufactured by Fuji Titanium Industry Co., Ltd.); MT-100S, MT-100T (both manufactured by TAYCA CORPORATION); and IT-S (manufactured by ISHIHARA SANGYO KAISHA, LTD.).

In order to attain hydrophobic oxide particles, silica particles, titania particles, or alumina particles, hydrophilic particles are treated with a silane coupling agent, such as methyl trimethoxy silane, or methyl triethoxy silane. Moreover, silicone oil-treated oxide particles or inorganic particles, which have been treated with silicone oil optionally by applying heat, are also suitable.

Examples of the silicone oil include dimethyl silicone oil, methylphenyl silicone oil, chlorophenyl silicone oil, methylhydrogen silicone oil, alkyl-modified silicone oil, fluorine-modified silicone oil, polyether-modified silicone oil, alcohol-modified silicone oil, amino-modified silicone oil, epoxy-modified silicone oil, epoxy/polyether-modified silicone oil, phenol-modified silicone oil, carboxyl-modified silicone oil, mercapto-modified silicone oil, acryl or methacryl-modified silicone oil, and α-methylstyrene-modified silicone oil. Examples of the inorganic particles include silica, alumina, titanium oxide, barium titanate, magnesium titanate, calcium titanate, strontium titanate, iron oxide, copper oxide, zinc oxide, tin oxide, quartz sand, clay, mica, wollastonite, diatomaceous earth, chromic oxide, cerium oxide, red iron oxide, antimony trioxide, magnesium oxide, zirconium oxide, barium sulfate, barium carbonate, calcium carbonate, silicon carbide, and silicon nitride. Among them, silica and titanium dioxide are particularly preferable. An amount thereof is 0.1% by mass to 5% by mass, preferably 0.3% by mass to 3% by mass, relative to the toner. The average primary particle diameter of the inorganic particles is 100 nm or smaller, preferably 3 nm to 70 nm. When the average primary particle diameter thereof is smaller than the aforementioned range, the inorganic particles are embedded in the toner particles, and therefore a function thereof may not be effectively exhibited. When the average primary particle diameter thereof is greater than the aforementioned range, the inorganic particles may unevenly damage a surface of a photoconductor, hence not preferable.

Examples of other polymeric particles include: polymer particles formed of soap-free emulsification polymerization, suspension polymerization, or dispersion polymerization, such as polystyrene, methacrylic acid ester copolymer, and acrylic ester copolymer; and polycondensation thermoset resin particles, such as silicone, benzoguanamine, and nylon.

<<Flow Improving Agent>>

The flow improving agent is an agent used to perform a surface treatment to increase hydrophobicity, to thereby prevent degradations of flowability and charging properties of the toner in high humidity environments. For example, the preferable surface treating agent includes a silane coupling agent, a sililation agent, a silane-coupling agent containing a fluoroalkyl group, an organic titanate-based coupling agent, an aluminum-based coupling agent, silicone oil, and modified-silicone oil.

<<Cleaning Improving Agent>>

The cleaning improving agent for removing a developer remained on a photoconductor or primary transfer member after transferring includes, for example, metal salts of fatty acid such as stearic acid (e.g. zinc stearate, and calcium stearate); and polymer particles produced by soap-free emulsification polymerization, such as polymethyl methacrylate particles, and polystyrene particles. As for the polymer particles, preferred are those having a relatively narrow particle size distribution and the volume average particle diameter of 0.01 μm to 1 μm.

<<Resin Particles>>

In the present invention, resin particles are optionally added. The resin particles for use preferably have glass transition temperature (Tg) of 40° C. to 100° C., and the weight average molecular weight of 3,000 to 300,000. When the resin particles have the grass transition temperature (Tg) of lower than 40° C., and/or the weight average molecular weight of less than 3,000, the storage stability of the toner is impaired so that blocking may occur during storage or inside a developing device. When the resin particles have the glass transition temperature (Tg) of higher than 100° C., and/or the weight average molecular weight of greater than 300,000, the resin particles hinder a resulting toner from adhering to fixing paper, to thereby elevate the minimum fixing temperature.

The persistence of the resin particles on the toner particles is preferably 0.5% by mass to 5.0% by mass. When the persistence is less than 0.5% by mass, the storage stability of the toner is impaired, and therefore blocking may occur during storage and inside a developing device. When the persistence is greater than 5.0% by mass, the resin particles hinder the wax from bleeding out, and therefore a releasing effect of the wax cannot be exhibited, to thereby cause offset.

The persistence of the resin particles can be determined by analyzing a substance, which is not originated from the toner particles but is originated from the resin particles, by a thermal decomposition gas chromatography mass spectrometer, and calculating from the obtained peak area.

As for a detector for the measurement, a mass spectrometer is preferable, but it is not limited to the mass spectrometer.

As for the resin particles, any resin can be used as long as it is a resin that can form an aqueous dispersion liquid, and the resin may be a thermoplastic resin, or a thermoset resin. Examples thereof include a vinyl-based resin, a polylactic acid resin, a polyurethane resin, an epoxy resin, a polyester resin, a polyamide resin, a polyimide resin, a silicon-based resin, a phenol resin, a melamine resin, a urea resin, an aniline resin, an iomer resin, and a polycarbonate resin. As for the resin particles, two or more of the above-listed resin may be used without any problem. Among them, a vinyl-based resin, a polyurethane resin, an epoxy resin, and a polyester resin, and any combination thereof are preferable as an aqueous dispersion liquid of spherical resin particles thereof can be easily formed.

The vinyl-based resin is a polymer obtained through homopolymerization or copolymerization of a vinyl-based monomer. Examples thereof include a styrene-(meth)acrylic acid ester resin, a styrene-butadiene copolymer, a (meth) acrylic acid-acrylic acid ester polymer, a styrene-acrylonitrile copolymer, a styrene-maleic anhydride copolymer, and a styrene-(meth)acrylic acid copolymer.

<<Crosslinking Agent and Elongation Agent>>

In the present invention, amines can be used as a crosslinking agent and/or elongation agent. Examples of the amine (B) include diamine (B1), tri- or higher polyamine (B2), amino alcohol (B3), aminomercaptan (B4), amino acid (B5), and a blocked compound (B6) where an amino group of any of the foregoing B1 to B5 is blocked. Examples of the diamine (B1) include: aromatic diamine (e.g., phenylene diamine, diethyl toluene diamine, and 4,4'-diaminodiphenyl methane); alicyclic diamine (e.g., 4,4'-diamino-3,3'-dimethyldichlorohexyl methane, diamine cyclohexane, and isophorone diamine); and alicyclic diamine (e.g., ethylene diamine, tetramethylene diamine, and hexamethylene diamine). Examples of the tri- or higher polyamine (B2) include diethylene triamine, and triethylene tetramine. Examples of the amino alcohol (B3) include ethanol amine, and hydroxyethyl aniline. Examples of the aminomercaptan (B4) include aminoethylmercaptan, and aminopropylmercaptan. Examples of the amino acid (B5) include amino propionic acid, and amino caproic acid. Examples of the blocked compound (B6) where an amino group of any of the foregoing B1 to B5 include a ketimine compound and oxazoline compound obtained from the amines of (B1) to (B5) and ketones (e.g., acetone, methyl ethyl ketone and methyl isobutyl ketone). Among these amines (B), preferred are B1, and a mixture of B1 with a small amount of B2.

Moreover, a terminator is optionally used for the crosslink and/or elongation to adjust a molecular weight of a modified polyester after the reaction. Examples of the terminator include: monoamine (e.g., diethyl amine, dibutyl amine, butyl amine, and lauryl amine), and a blocked product thereof (e.g., a ketimine compound).

A ratio of the amine (B) is determined as an equivalent ratio [NCO]/[NHx] of isocyanate groups [NCO] in the prepolymer having an isocyanate group (A) to amino groups [NHx] in the amine (B), which is typically 1/2 to 2/1, preferably 1.5/1 to 1/1.5, and more preferably 1.2/1 to 1/1.2. When the ratio [NCO]/[NHx] is greater than 2, or less than 1/2, a molecular weight of the urea-modified polyester (i) becomes low, which leads to poor hot offset resistance.

The toner binder can be produced by the following method. Polyol (1) and polycarboxylic acid (2) are heated to the temperature ranging from 150° C. to 280° C. in the presence of a conventional esterification catalyst, such as tetrabutoxy titanate, and dibutyl tin oxide, optionally with removing generated water under the reduced pressure, to thereby obtain polyester having a hydroxyl group. Subsequently, the obtained polyester is allowed to react with polyisocyanate (3) at 40° C. to 140° C., to thereby obtain prepolymer having an isocyanate group (A).

The dry toner of the present invention can be produced by the following method, but the production method is not limited to the following method.

<Toner Production Method in Aqueous Medium>

The resin particles are preferably added to the aqueous phase used in the present invention in advance. The resin particles act as a particle size regulator, to surround toner particles, and eventually, the resin particles cover a surface of a toner particle and act as a shell layer. Precise control and adjustments are important to impart a sufficient function as a shell layer, as it is influenced by a particle size of the resin particles, a composition of the resin particle, a dispersant (surfactant) and a solvent for use in the aqueous phase.

Water used for the aqueous phase may be water alone, or may be a combination of water and a solvent miscible with water. Examples of the solvent miscible with water include alcohol (e.g., methanol, isopropanol, ethylene glycol), dimethylformamide, tetrahydrofuran, cellosolve (e.g., methyl cellosolve), and lower ketone (e.g., acetone, and methyl ethyl ketone).

The toner particles are obtained by reacting dispersed element, which have been prepared by dissolving or dispersing the polyester prepolymer having an isocyanate group (A) in an organic solvent, with the amine (B) in the aqueous phase, to thereby form toner particles. Examples of a method for stably forming dispersed element formed of the polyester prepolymer (A) in the aqueous phase include a method containing adding a toner raw material composition, which has been prepared by dissolving or dispersed the polyester prepolymer (A) in an organic solvent, to the aqueous phase, and dispersing the mixture by applying shearing force. The polyester prepolymer (A) dissolved or dispersed in the organic solvent, and other materials in the toner composition (may be referred to as "toner raw materials" hereinafter), such as a colorant, colorant master batch, releasing agent, charge controlling agent, and unmodified polyester resin, may be mixed when dispersed elements are formed in the aqueous phase, but it is preferred that the toner raw materials be mixed in advance, followed by dissolving or dispersing the mixture in an organic solvent, and the resulting mixture be added to and dispersed in an aqueous phase. In the present invention, moreover, other toner raw materials, such as a colorant, releasing agent, and charge controlling agent, are not necessarily mixed when particles are formed in the aqueous phase. They may be added after forming particles. For example, after forming particles which do not contain a colorant, a colorant can be added by a conventional dying method.

A method of dispersing is not particularly limited, but any conventional system, such as a low-speed shearing disperser, a high-speed shearing disperser, a friction disperser, a high-pressure jetting disperser and an ultrasonic wave disperser, can be used. Among them, the high-speed shearing disperser is preferable, because it can control the particle diameters of the dispersed elements to the range of 2 μm to 20 μm. In the case where the high-speed shearing disperser is used, the rotating speed is not particularly limited, but it is typically 1,000 rpm to 30,000 rpm, preferably 5,000 rpm to 20,000 rpm. The dispersion time is not particularly limited, but it is typically 0.1 minutes to 5 minutes in case of a batch system. The temperature during the dispersing is typically 0° C. to 150° C. (under the pressure), preferably 40° C. to 98° C. The higher temperature s preferable, as the viscosity of the dispersed element formed of the polyester prepolymer (A) is low, and dispersing is easily carried out.

An amount of the aqueous phase used relative to 100 parts by mass of a toner composition containing the polyester prepolymer is typically 50 parts by mass to 2,000 parts by mass, preferably 100 parts by mass to 1,000 parts by mass. When the amount thereof is less than 50 parts by mass, the dispersed state of the toner composition is poor and therefore toner particles having the predetermined particle size cannot be attained. When the amount thereof is greater than 2,000 parts by mass, it is not economical. Moreover, a dispersing agent can be optionally used. Use of the dispersing agent is preferable, as a particle size distribution of resulting toner particles becomes sharp, and a dispersion becomes stable.

Examples of the dispersing agent for dispersing and emulsifying the oil phase, in which the toner composition has been dispersed, in the aqueous phase include: anionic surfactants such as alkylbenzenesulfonic acid salts, α-olefin sulfonic acid salts and phosphoric acid esters; cationic surfactants such as amine salts (e.g., alkyl amine salts, amino alcohol fatty acid derivatives, polyamine fatty acid derivatives and imidazoline), and quaternary ammonium salts (e.g., alkyltrimethylammonium salts, dialkyl dimethylammonium salts, alkyl dimethyl benzyl ammonium salts, pyridinium salts, alkyl isoquinolinium salts and benzethonium chloride); nonionic surfactants such as fatty acid amide derivatives and polyhydric alcohol derivatives; and amphoteric surfactants such as alanine, dodecyldi(aminoethyl) glycine, di(octylaminoethyl)glycine and N-alkyl-N,N-dimethylammonium betaine.

Also, a fluoroalkyl group-containing surfactant can exhibit its dispersing effects even in a small amount. Preferable examples of the fluoroalkyl group-containing anionic surfactant include fluoroalkyl carboxylic acid having 2 to 10 carbon atoms and metal salts thereof, disodium perfluorooctanesulfonylglutamate, sodium 3-[ω-fluoroalkyl(C6-C11) oxy)-1-alkyl(C3-C4) sulfonate, sodium 3-[ω-fluoroalkanoyl (C6-C8)-N-ethylamino]-1-propanesulfonate, fluoroalkyl (C11-C20) carboxylic acid and metal salts thereof, perfluoroalkylcarboxylic acid(C7-C13) and metal salts thereof, perfluoroalkyl(C4-C12)sulfonate and metal salts thereof, perfluorooctanesulfonic acid diethanol amide, N-propyl-N-(2-hydroxyethyl)perfluorooctanesulfone amide, perfluoroalkyl(C6-C10)sulfoneamidepropyltrimethylammonium salts, salts of perfluoroalkyl(C6-C10)-N-ethylsulfonylglycin and monoperfluoroalkyl(C6-C16) ethylphospliate.

Examples of the commercial product thereof include: SURFLON S-111, S-112, S-113 (all manufactured by Asahi Glass Co., Ltd.); FLUORAD FC-93, FC-95, FC-98, FC-129 (all manufactured by Sumitomo 3M Limited); UNIDYNE DS-101, DS-102 (all manufactured by DAIKIN INDUSTRIES, LTD.); MEGAFAC F-110, F-120, F-113, F-191, F-812, F-833 (all manufactured by DIC Corporation); EFTOP EF-102, 103, 104, 105, 112, 123A, 123B, 306A, 501, 201, 204, (all manufactured by Mitsubishi Materials Electronic Chemicals Co., Ltd.); and FUTARGENT F-100, F150 (all manufactured by NEOS COMPANY LIMITED).

Examples of the cationic surfactant include fluoroalkyl group-containing primary, secondary or tertiary aliphatic compounds, aliphatic quaternary ammonium salts (e.g., perfluoroalkyl (C6-C10) sulfonamide propyltrimethyl ammonium salts), benzalkonium salts, benzetonium chloride, pyridinium salts and imidazolinium salts. Examples of the commercial product thereof include: SURFLON S-121 (manufactured by Asahi Glass Co., Ltd.); FLUORAD FC-135 (manufactured by Sumitomo 3M Limited); UNIDYNE DS-202 (manufactured by DAIKIN INDUSTRIES, LTD.); MEGAFAC F-150, F-824 (all manufactured by DIC Corporation); EFTOP EF-132 (manufactured by Mitsubishi Materials Electronic Chemicals Co., Ltd); and FUTARGENT F-300 (manufactured by NEOS COMPANY LIMITED).

Moreover, a water-insoluble inorganic compound dispersing agent, such as tricalcium phosphate, calcium carbonate, titanium oxide, colloidal silica, and hydroxyapatite, can also used as the dispersing agent.

Moreover, dispersed droplets may be stabilized with tricalcium phosphate, calcium carbonate, titanium oxide, colloidal silica, and hydroxyapatite, can also used as the dispersing agent. Examples thereof include: acid, such as acrylic acid, methacrylic acid, α-cyanoacrylic acid, α-cyanomethacrylic acid, itaconic acid, crotonic acid, fumaric acid, maleic acid and maleic anhydride; hydroxyl group-containing (meth)acrylic-based monomer, such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylic acid esters, diethylene glycol monomethacrylic acid esters, glycerin monoacrylic acid esters, glycerin monomethacrylic acid esters, N-methylolacrylamide and N-methylolmethacrylamide; ester formed between vinyl alcohol and a compound containing a carboxyl group. such as vinyl acetate, vinyl propionate and vinyl butyrate; acrylamide, methacrylamide, diacetone acrylamide and a methylol compound of thereof; acid chlorides, such as acrylic acid chloride and methacrylic acid chloride; homopolymer or copolymer containing a nitrogen atom or nitrogen-containing heterocyclic ring, such as vinyl pyridine, vinyl pyrrolidone, vinyl imidazole and ethyleneimine; polyoxyethylene, such as polyoxyethylene, polyoxypropylene, polyoxyethylene alkyl amines, polyoxypropylene alkyl amines, polyoxyethylene alkyl amides, polyoxypropylene alkyl amides, polyoxyethylene nonylphenyl ethers, polyoxyethylene laurylphenyl ethers, polyoxyethylene stearylphenyl esters and polyoxyethylene nonylphenyl esters; and cellulose, such as methyl cellulose, hydroxyethyl cellulose and hydroxypropyl cellulose.

In the case where calcium phosphate or the like that is soluble in acid and alkali is used as a dispersion stabilizer, the calcium phosphate is dissolved by acid such as hydrochloric acid, followed by washing with water, to thereby remove the calcium phosphate from the particles. Alternatively, it can be removed by decomposition using enzyme.

In the case where the dispersing agent is used, the dispersing agent may be left on surfaces of the toner particles, but the dispersing agent is preferably removed by washing after the elongation and/or crosslink reaction in view of charging ability of a resulting toner.

The duration of the elongation and/or crosslink reaction is selected, for example, depending on reactivity between the isocyanate group structure contained in the prepolymer (A) for use and the amine (B) for use, but it is typically 10 minutes to 40 hours, preferably 2 hours to 24 hours. The reaction temperature is typically 0° C. to 150° C., preferably 40° C. to 98° C. Moreover, a conventional catalyst may be used, if necessary. Specific examples of the catalyst include dibutyl tin laurate, and dioctyl tin laurate.

In order to remove the organic solvent from the obtained emulsified dispersion liquid, employed can be a method where the entire liquid is gradually heated to completely evaporate and remove the organic solvent contained in the dispersed droplets. It is also possible that the emulsified dispersion liquid is sprayed in a dry atmosphere to completely evaporate and remove the water-insoluble organic solvent in the droplets to thereby form toner particles, at the same time as evaporating and removing the aqueous dispersant. As for the dry atmosphere in which the emulsified dispersion liquid is sprayed, heated gas (e.g., air, nitrogen, carbon dioxide and combustion gas), especially, gas flow heated to temperature equal to or higher than the boiling point of the solvent for use, is generally used. The treatment of a short period by a spray dryer, a belt dryer or a rotary kiln can sufficiently provide the intended quality.

A method for removing the organic solvent, the organic solvent can be removed by blowing air by a rotary evaporator or the like.

Thereafter, rough separation was performed by centrifugal separation, the obtained emulsified dispersed element are washed in a washing tank, and the resultant is dried by a hot air drier. This series of the processes is performed, followed by removing the solvent, and drying, to thereby obtain toner base particles.

Thereafter, the toner base particles are preferably subjected to maturing. Preferably, the toner base particles are matured at 30° C. to 55° C. (more preferably 40° C. to 50° C.), for 5 hours to 36 hours (more preferably 10 hours to 24 hours).

In the case where a particle size distribution is wide during emulsifying and dispersing, and the resultant is washed and dried with maintaining such particle size distribution, the toner base particles can be subjected to classification to control the particle size distribution thereof to the intended particle size distribution.

The classification may be carried out in a liquid by removing small particles by cyclone, a decanter, or centrifugal separator. Of course, the classification can be performed on particles after drying and collecting as a powder. The classification performed in a liquid is preferable in view of its efficiency. The obtained waste fine particles or coarse particles are returned again to the kneading process to be used for formation of particles. At this time, waste fine particles or coarse particles may be in a wet state.

The used dispersing agent is preferably removed from the obtained dispersion liquid as much as possible, which is preferably performed at the same time as the aforementioned classification.

The obtained dried toner powder may be mixed together with different particles, such as releasing agent particles, charge controlling agent particles, flow improving agent particles, and colorant particles, or mechanical impact is applied to mixed powder to fix or fuse the different particles on surfaces of the toner particles. As a result, the different particles can be prevented from falling off from the surfaces of the obtained composite particles.

As for a specific method thereof, there are: a method for applying impulse force to a mixture by a blade rotating at high speed; a method for adding a mixture into a high-speed air flow and accelerating the speed of the flow to thereby make the particles crash into other particles, or make the composite particles crush into an appropriate impact board. Examples of a device used for this method include ANGMILL (product of Hosokawa Micron Corporation), an apparatus produced by modifying I-type mill (product of Nippon Pneumatic Mfg. Co., Ltd.) to reduce the pulverizing air pressure, a hybridization system (product of Nara Machinery Co., Ltd.), a kryptron system (product of Kawasaki Heavy Industries, Ltd.) and an automatic mortar.

Finally, external additives, such as inorganic particles, and the toner are mixed by HENSCHEL MIXER, and coarse particles are removed by ultrasonic wave sieve, to thereby obtain a toner, as a final product.

<<Definition of Crystallinity>>

In the present specification, a toner having crystallinity is defined as follows:

(1) A toner, whose a lamella structure can be confirmed by observing a thin slice of the toner, which is prepared for the observation of the cross-section thereof, and is dyed with ruthenium tetraoxide or osmium tetraoxide, by TEM.

(2) A toner, with which a melting peak appears in a constant speed component, as the toner is subjected to temperature modulated DSC.

<Confirmation of Core-Shell Toner Structure>

In the present invention, the core-shell toner structure can be confirmed and evaluated by the following method using transmission electron microscope (TEM). The core-shell structure is determined as a state where a surface of a toner particle is covered with a contrast component different from the components inside the toner particle. A thickness of the shell layer is preferably 50 nm or greater.

First, about one spatula full of the toner is embedded in an epoxy resin and then the resin is cured. The sample is dyed with ruthenium tetraoxide, or osmium tetraoxide, or another dye, and is exposed to gas for 1 minute to 24 hours, to thereby identify the shell layer and the inner core. The duration of the exposure is appropriately adjusted depending on the desirable contrast during observing. Then, the epoxy resin is cut by a knife, Ultramicrotome (ULTRACUT UCT, manufactured by Leica Microsystems, using diamond knife) to expose a cross-section, to thereby prepare an ultra-thin cut piece (thickness: 200 nm) of the toner. Thereafter, the cut piece is observed under a transmission electron microscope (TEM, H7000, manufactured by Hitachi High-Technologies Corporation) at the accelerating voltage of 100 kV. Note that, there is a case where the shell layer and the core can be identified without dying, depending on the compositions thereof. In such a case, the evaluation is carried out without dying. Moreover, it is also possible to give a contrast to the compositions with other methods, such as selective etching. It is also preferable to evaluate the shell layer through TEM observation after such pretreatment.

<System Linear Velocity>

In the present invention, the system linear velocity is measured in the following manner. One hundred of A4-size paper are continuously output by the image forming apparatus, with longitudinal feeding direction (length of paper in the feeding direction: 297 mm). The output time from the start to the end is determined as A seconds, and the system speed is determined as B. The system linear velocity is obtained by the following formula.

$$B(\text{mm/sec})=100\ \text{sheets}\times 297\ \text{mm}/A\ \text{seconds}$$

<Fixing Contact Pressure>

As for the fixing contact pressure in the present invention, contact pressure to press the recording medium can be measured by means of a pressure distribution measuring device PINCH (manufactured by NITTA Corporation).

<Fixing Nip Time>

The fixing nip time is calculated from the measurements of the linear velocity and the fixing nip width.

(Process Cartridge)

The process cartridge of the present invention contains at least a latent electrostatic image bearing member configured to bear a latent electrostatic image, and a developing unit configured to develop the latent electrostatic image on the latent electrostatic image bearing member with a toner to form a visible image, and may further contain other units, if necessary.

The toner is the aforementioned toner of the present invention.

Figure 2:
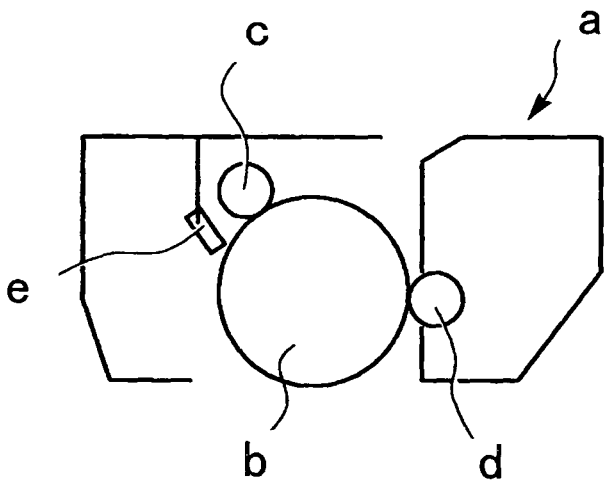
FIG. 2 is a schematic diagram depicting one example of a structure of an image forming apparatus equipped with the process cartridge of the present invention.

FIG. 2 is a schematic diagram illustrating a structure of an image forming apparatus equipped with the process cartridge of the present invention. In FIG. 2, "a" is an entire process cartridge, "b" is a photoconductor, "c" is a charging unit, "d" is a developing unit, and "e" is a cleaning unit.

In the present invention, among the aforementioned constitutional elements, such as the photoconductor b, the charging unit c, the developing unit d, and cleaning unit e, at least the photoconductor b, and developing unit d are integrally structured as a process cartridge e, and this process cartridge e is detachably mounted in a main body of an image forming apparatus, such as a photocopier, and a printer.

(Two-Component Developer)

The two-component developer of the present invention contains the toner of the present invention, and a magnetic carrier.

In the case where the toner of the present invention is used for a two-component developer, the toner can be mixed with a magnetic carrier. As for the blending ratio of the carrier and the toner in the developer, an amount of the toner is preferably 1 part by mass to 10 parts by mass relative to 100 parts by mass of the carrier. The magnetic carrier can be selected from conventional magnetic carrier such as iron powder, ferrite powder, magnetite powder and magnetic resin carrier each having a particle diameter of about 20 μm to about 200 μm. As for a coating material for the carrier, an amino-based resin has been known. Examples of the amino-based resin include a urea-formaldehyde resin, a melamine resin, a benzoguanamine resin, a urea resin, a polyamide resin, and an epoxy resin. Other examples of the coating material include: a polyvinyl-based resin and a polyvinylidene-based resin, such as an acrylic resin, a polymethyl methacrylate resin, a polyacrylonitrile resin, a polyvinyl acetate resin, a polyvinyl alcohol resin, and a polyvinyl butyral resin; a polystyrene-based resin such as a polystyrene resin, and a styrene-acryl copolymer resin; a halogenated olefin resin such as polyvinyl chloride; a polyester-based resin such as a polyethylene terephthalate resin, and a polybutylene terephthalate resin; a polycarbonate-based resin; and others such as a polyethylene resin, a polyvinyl fluoride resin, a polyvinylidene fluoride resin, a polytrifluoroethylene resin, a polyhexafluoropropylene resin, a copolymer of vinylidene fluoride and acryl monomer, a copolymer of vinylidene fluoride and vinyl fluoride, fluoroterpolymer (e.g. a terpolymer of tetrafluoroethylene, vinylidene fluoride, and non-fluoride monomer), and a silicone resin. Moreover, the resin coating may contain electroconductive powder, if necessary. As for the electroconductive powder, metal powder, carbon black, titanium oxide, tin oxide and zinc oxide can be used. The average particle diameter of the conductive powder is preferably 1 μm or smaller. When the average particle diameter thereof is larger than 1 μm, it may be difficult to control the electric resistance.

The toner of the present invention can be used as a one-component magnetic toner or non-magnetic toner without a carrier.

(Image Forming Apparatus and Image Forming Method)

The image forming apparatus of the present invention contains a latent electrostatic image bearing member, a latent electrostatic image forming unit configured to form a latent electrostatic image on the latent electrostatic image bearing member, a developing unit configured to develop the latent electrostatic image with a toner to form a visible image, a transferring unit configured to transfer the visible image onto a recording medium, and a fixing unit configured to fix the visible image on the recording medium with heat and pressure applied by a fixing member, and may further contain other units, if necessary.

The image forming apparatus of the present invention employs a tandem developing system where at least four image forming units each using a different color for developing are tandemly provided, and a system speed thereof is 200 mm/sec to 3,000 mm/sec, and wherein contact pressure of the pressing fixing member is 10 N/cm$^2$ to 3,000 N/cm$^2$, and a fixing nip time is 30 msec to 400 msec.

The toner is the toner of the present invention.

The image forming method of the present invention contains: forming a latent electrostatic image on a latent electrostatic image bearing member; developing the latent electrostatic image with a toner to form a visible image; transferring the visible image onto a recording medium; and fixing the visible image on the recording medium with heat and pressure of a fixing member, wherein the image forming method employs a tandem developing system where at least four image forming units each using a different color for developing are tandemly provided, and a system speed thereof is 200 mm/sec to 3,000 mm/sec, and wherein contact pressure of the pressing fixing member is 10 N/cm$^2$ to 3,000 N/cm$^2$, and a fixing nip time is 30 msec to 400 msec.

The toner is the aforementioned toner of the present invention.

<Tandem Color Image Forming Apparatus>

Figure 3:
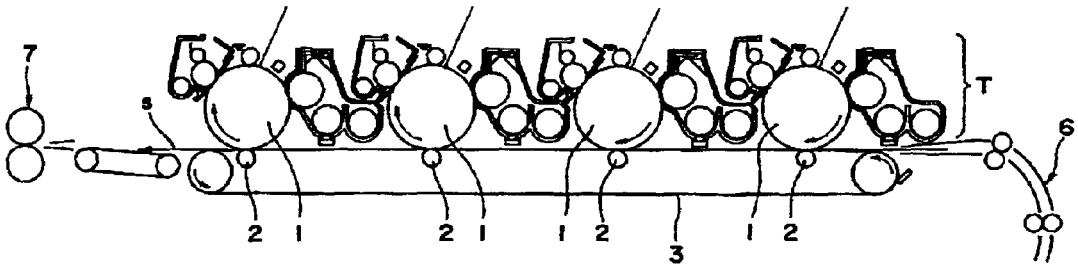
FIG. 3 is a schematic diagram depicting one example a tandem image forming apparatus.
Figure 4:
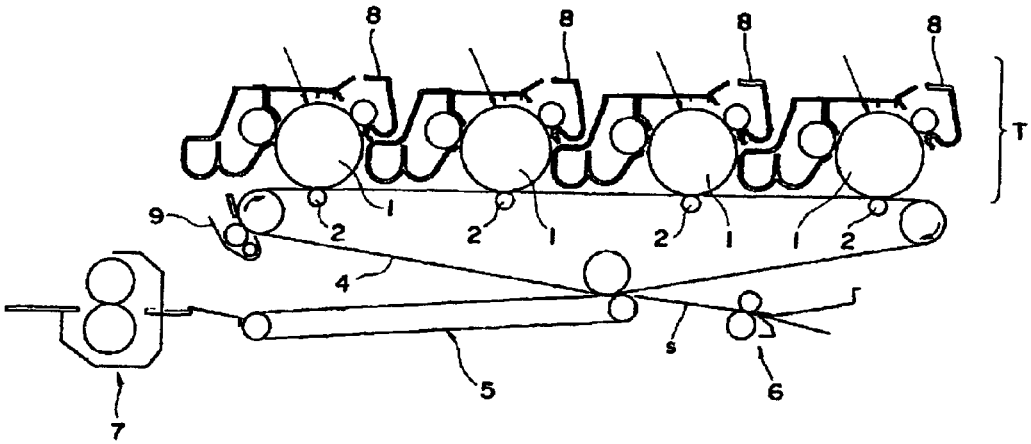
FIG. 4 is a schematic diagram depicting another example a tandem image forming apparatus.

In the present invention, the image forming apparatus can be used as a color image forming apparatus of a tandem developing system, where at least four or more image forming units each using a different developing color are tandemly aligned. One example of the embodiment of a tandem color image forming apparatus is explained hereinafter. As for the tandem electrophotographic device, there are a tandem image forming apparatus using a direct transfer system, as illustrated in FIG. 3, where images on photoconductors 1 are successively transferred by a transfer device 2 to a sheet s transported by a sheet conveying belt 3, and a tandem image forming apparatus using an indirect transfer system, as illustrated in FIG. 4, where images on photoconductors 1 are successively transferred temporarily to an intermediate transfer member 4 by a primary transfer device 2, and then, the images on the intermediate transfer member 4 are collectively transferred to a sheet s by a secondary transfer device 5. The transfer device 5 is a transfer convey belt, but the transfer device may also employ a roller system.

Comparing the direct transfer system and the indirect transfer system, the direct transfer system has a disadvantage that a size of the device increases along the sheet conveying direction, as a feeding device 6 needs to be provided at the upstream side of the tandem image forming apparatus T where the photoconductors 1 are aligned, and a fixing device 7 needs to be provided at the downstream side thereof.

On the other hand, a position of secondary transfer can be relatively freely designed in the indirect transfer system. Moreover, the feeding device 6, and the fixing device 7 can be provided below the tandem image forming apparatus T, and therefore there is an advantage in down sizing.

In order to prevent the tandem image forming apparatus from increasing its size in the sheet conveying direction in the direct transfer system, the fixing device 7 is provided adjacent to the tandem image forming apparatus T. Therefore, the fixing device 7 cannot be provided to have an enough space to the sheet s to be bent, and the fixing device 7 tends to be influenced by an impact caused when an edge of the sheet s enters the fixing device 7 (which becomes significant, particularly, with use of a thick sheet), or a speed difference between the sheet conveying speed at the time the sheet is passed through the fixing device 7 and the sheet conveying speed at the time the sheet is conveyed by the transfer convey belt. As a result, the upstream side of an image to be formed tends to be affected.

On the other hand, in the indirect transfer system, the fixing device 7 can be provided with a sufficient space so that the sheet s can be bent, any influence of the fixing device 7 can be given to image formation.

From the reasons as described above, among tandem electrophotographic devices, particularly that of the indirect transfer system has been attracted attentions.

In this type of a color electrophotographic device, as illustrated in FIG. 4, a residual toner remained on the photoconductor 1 after primary transferring is removed by the photoconductor cleaning device 8 to clean a surface of the photoconductor 1, to thereby prepare for forthcoming image formation. Moreover, the residual transfer toner remained on the intermediate transfer member 4 after secondary transferring is removed by the intermediate transfer member cleaning device 9 to clean a surface of the intermediate transfer member 4, to thereby prepare for the forthcoming image formation.

The embodiment of the present invention is explained with reference to the drawings hereinafter.

Figure 5:
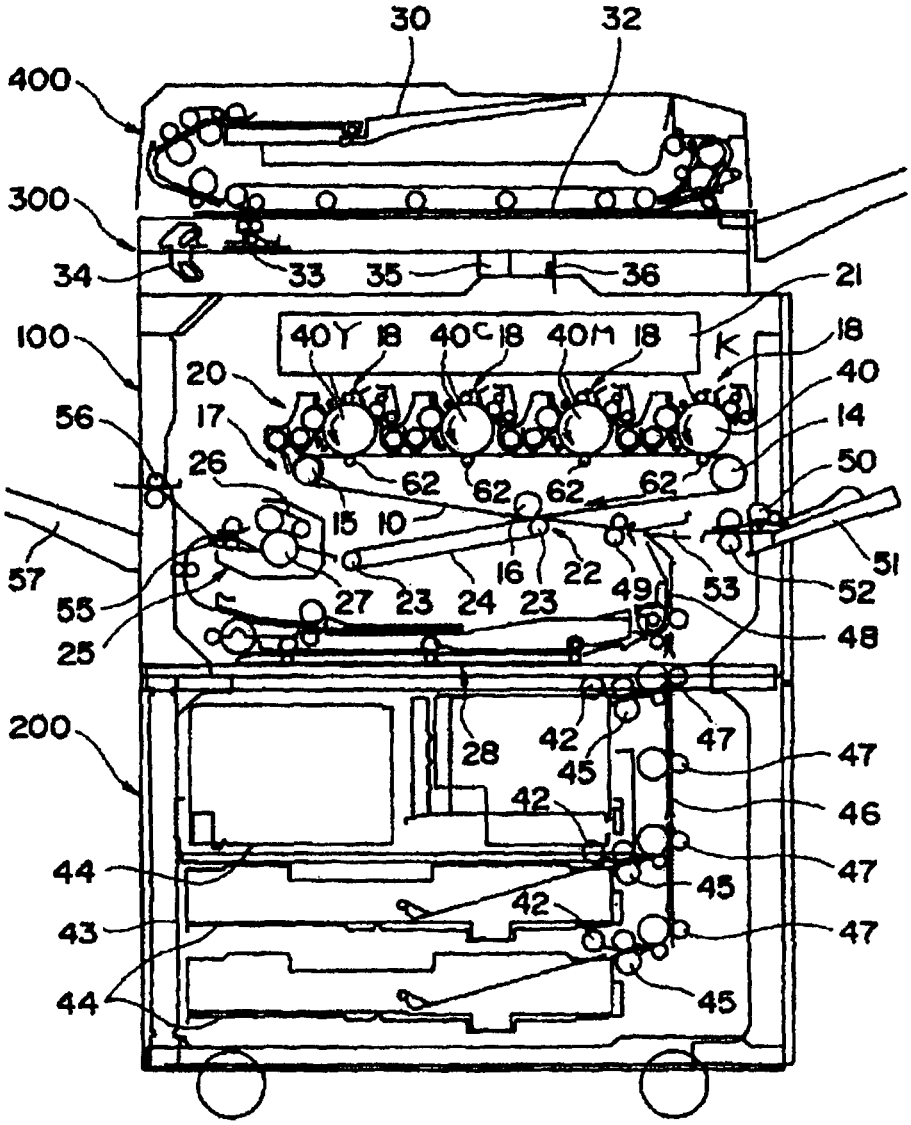
FIG. 5 is a schematic diagram depicting one example of a tandem image forming apparatus employing an indirect transfer system.
Figure 6:
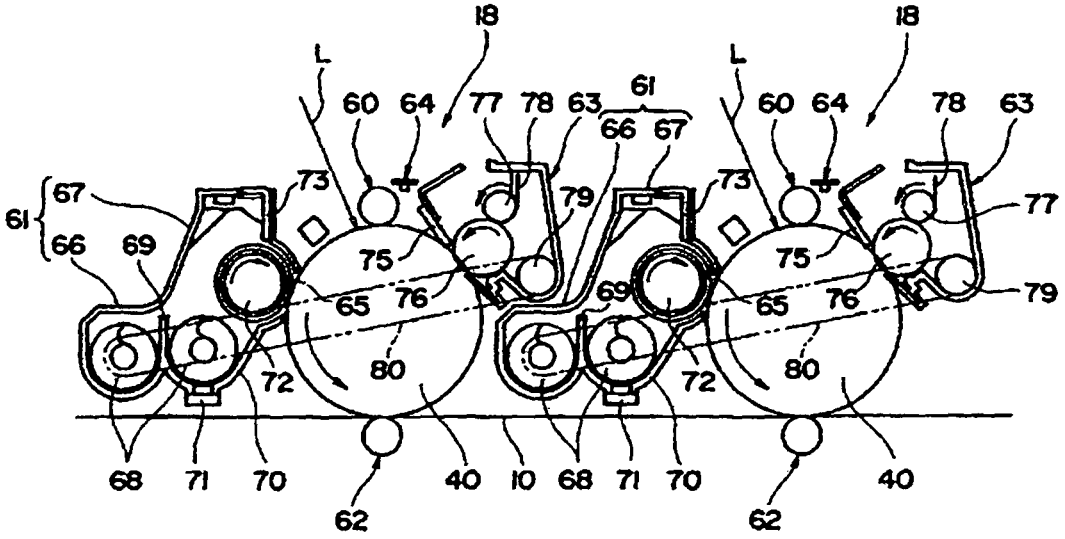
FIG. 6 is a schematic diagram depicting one example of details of a tandem image forming apparatus.

FIG. 5 depicts one embodiment of the present invention, and illustrates an electrophotographic device of a tandem indirect transfer system. In FIG. 5, 100 is a main body of a photocopier, 200 is a feeding table on which the main body is provided, 300 is a scanner provided on the main body 100, and 400 is an automatic document feeder (ADF) provided on the scanner 300. In the central part of the main body 100, an intermediate transfer member 10 in the form of an endless belt is provided.

The intermediate transfer member 10 is rotatably supported by three support rollers 14, 15, and 16 in the clockwise direction in FIG. 5.

In this example shown in FIG. 5, an intermediate transfer member cleaning device 17, which is configured to remove the residual toner on the intermediate transfer member 10 after transferring an image, is provided at the left hand side of the second support roller 15 among these three rollers.

Above the area of the intermediate transfer member 10 supported between the first support roller 14 and the second support roller 15 out of the three roller, four image forming units 18 of yellow, cyan, magenta, and black are horizontally aligned along the conveying direction of the intermediate transfer member 10, to thereby constitute the tandem image forming apparatus 20.

As illustrated in FIG. 5, an exposing device 21 is further provided above the tandem image forming apparatus 20. A secondary transfer device 22 is provided at the opposite side of the intermediate transfer member 20 to the side where the tandem image forming apparatus 20 is provided. In the illustrated example, the secondary transfer device 22 is formed by providing a secondary transfer belt 24, which is an endless belt, around two rollers 23, and is provided in the manner that the secondary transfer device 22 is pressed against the support roller 16 via the intermediate transfer member 10. As a result of this structure, the image on the intermediate transfer member 10 is transferred onto a sheet.

A fixing device 25 configured to fix the transferred image on the sheet is provided next to the secondary transfer device 22. The fixing device 25 contains a fixing belt 26, which is an endless belt, and a pressure roller 27 provided to be pressed against the fixing belt 26.

The aforementioned secondary transfer device 22 also has a sheet conveying function for conveying the sheet, to which the image has been transferred, to the fixing device 25. Of course, a transfer roller, or a non-contact charger can be provided as the secondary transfer device 22. In such case, however, it is difficult to provide a sheet conveying function to the secondary transfer device 22.

In the illustrated example, a sheet reverser 28, which is configured to reverse the sheet to perform image formation on both sides of the sheet, is provided below the secondary transfer device 22 and the fixing device 25, and horizontal to the tandem image forming apparatus 20.

Upon using the color electrophotographic device for taking a photocopy, first, a document is set on a document table 30 of the automatic document feeder (ADF) 400. Alternatively, the automatic document feeder (ADF) 400 is opened, a document is set on a contact glass 32 of the scanner 300, and then the ADF 400 is closed to press the document.

In the case where the document is set on the ADF 400, once a start switch (not illustrated) is pressed, the document is transported onto the contact glass 32, and then the scanner 300 is driven to scan the document with a first carriage 33 equipped with a light source and a second carriage 34 equipped with a mirror. In the case where the document is set on the contact glass 32, the scanner 300 is immediately driven in the same manner as mentioned. During this scanning operation, light applied from a light source of the first carriage 33 is reflected on the surface of the document, the reflected light from the document is further reflected by a mirror of the second carriage 34, and passed through an image formation lens 35, which is then received by a read sensor 36.

Once the start switch (not illustrated) is pressed, moreover, support rollers 14, 15, 16 are each rotatably driven by a driving motor (not illustrated) to rotate and convey the intermediate transfer member 10. At the same time, in each image forming unit 18, its photoconductor 40 is rotated, to thereby form a monocolor image of black, yellow, magenta, or cyan on each photoconductor 40. Then, along the movement of the intermediate transfer member 10, these monocolor images are sequentially transferred onto the intermediate transfer member 10, to thereby form a composite color image on the intermediate transfer member 10.

Once the start switch (not illustrated) is pressed, one of the feeding rollers 42 of the feeding table 200 is selectively rotated to eject a sheet (recording paper) from one of multiple feeder cassettes 44 of a paper bank 43, the ejected sheets are separated one by one by a separation roller 45 to send to a feeder path 46, and then transported by a transport roller 47 into a feeder path 48 within the photocopier main body 100. The sheet transported in the feeder path 48 is then bumped against a registration roller 49 to stop.

Alternatively, sheets (recording paper) on a manual-feeding tray 51 are ejected by rotating a feeding roller 50 separated one by one by a separation roller 52 to guide into a manual feeder path 53, and then bumped against the registration roller 49 to stop.

Next, the registration roller 49 is rotated synchronously with the movement of the composite color image on the intermediate transfer member 10, and a sheet is sent between the intermediate transfer member 10 and the secondary transfer device 22. Then, the composite color image is transferred onto the sheet by the secondary transfer device 22, to thereby record the color image on the sheet.

The sheet, on which the image has been transferred, is transported by the secondary transfer device 22 to the fixing device 25. In the fixing device 25, heat and pressure are applied to fix the transferred image. Thereafter, the sheet is changed its traveling direction by a switch craw 55, ejected by an ejecting roller 56, and then stacked on an output tray 57. Alternatively, the sheet is changed its traveling direction by the switch craw 55, reversed by the sheet reverser 28 to send to a transfer position, to thereby record an image on the back side thereof. Then, the sheet is ejected by the ejecting roller 56, and stacked on the output tray 57.

Meanwhile, after transferring the image, the residual toner on the intermediate transfer member 10 is removed by the intermediate transfer member cleaning device 17, to be prepared for a forthcoming image formation carried out by the tandem image forming apparatus 20.

Note that, the registration roller 49 is generally earthed at the time of the use, but it may be biased for removing paper dust of the recording paper.

In the tandem image forming apparatus 20, specifically, each image forming unit 18 contains, as illustrated in FIG.

6, a charging device 60, a developing device 61, a primary transfer device 62, a photoconductor cleaning device 63, and a diselectrification device 64 in the surrounding area of the drum-shaped photoconductor 40.

EXAMPLES

The present invention will be further explained through Examples hereinafter, but Examples shall not be construed as to limit the present invention.

(Evaluation Device)

As an evaluation device, a modified image forming apparatus (imagio MP C6000, manufactured by Ricoh Company Limited) in which a modification had been made mainly in a fixing section, was used. The linear velocity thereof was set to 350 mm/sec. Moreover, a fixing unit of the fixing section was adjusted to have fixing contact pressure of 40 $N/cm^2$, and fixing nip time of 40 ms. As for a surface of a fixing medium, a tetrafluoroethylene-perfluoroalkylvinyl ether copolymer resin (PFA) was applied, and shaped, and a surface thereof was adjusted. The resultant was used as the surface of the fixing medium.

(Evaluation of Two-Component Developer)

In the case where an image evaluation was performed with a two-component developer, a developer was prepared using a ferrite carrier having the average particle diameter of 35 μm, which had been coated with a silicone resin in the average thickness of 0.5 μm as described below, by homogeneously mixing and charging 7 parts by mass of the toner of each color with 100 parts by mass of the carrier in a tubular mixer that was a type where a container thereof was rolled to stir the contents.

(Production of Carrier)

| Core material | |
|---|---|
| Mn ferrite particles (weight average particle diameter 35 μm) | 5,000 parts by mass |
| **Coating materials** | |
| Toluene | 450 parts by mass |
| Silicone resin SR2400 (manufactured by Dow Corning Toray Co., Ltd., nonvolatile component: 50% by mass) | 450 parts by mass |
| Aminosilane (SH6020, manufactured by Dow Corning Toray Co., Ltd.) | 10 parts by mass |
| Carbon black | 10 parts by mass |

The above-listed coating materials were dispersed by a stirrer for 10 minutes to prepare a coating liquid. A coating device was charged with the prepared coating liquid and the core material to coat the core material with the coating liquid. The coating device was configured to perform coating by forming a rotational flow of the coating liquid and the core material in the fluid bed, to which a rotational bottom plate disk, and a stirring blade had been provided. The obtained coated product was baked at 250° C. for 2 hours in an electric furnace, to thereby obtain the carrier.

Example 1

Synthesis of Resin Particle Emulsion

A reaction vessel equipped with a stirring bar and a thermometer was charged with 683 parts by mass of water, 11 parts by mass of sodium salt of sulfuric acid ester of methacrylic acid-ethylene oxide adduct (ELEMINOL RS-30, manufactured by Sanyo Chemical Industries, Ltd.), 10 parts by mass of polylactic acid, 60 parts by mass of styrene, 100 parts by mass of methacrylic acid, 70 parts by mass of butyl acrylate, and 1 part by mass of ammonium persulfate, and the resulting mixture was stirred for 30 minutes at 3,800 rpm, to thereby obtain a white emulsion. The obtained emulsion was heated until the internal system temperature reached 75° C., and was allowed to react for 4 hours. Subsequently, a 1% by mass aqueous ammonium persulfate solution (30 parts) was added to the reaction mixture, followed by aging for 6 hours at 75° C., to thereby prepare Resin Particle Dispersion Liquid 1, which was an aqueous dispersion liquid of a vinyl resin (a copolymer of styrene/methacrylic acid/butyl acrylate/sodium salt of sulfuric acid ester of methacrylic acid ethylene oxide adduct). Part of Particle Dispersion Liquid 1 was dried to separate a resin component.

—Preparation of Aqueous Phase—

Water (990 parts by mass), 83 parts by mass of Particle Dispersion Liquid 1, 37 parts by mass of a 48.5% sodium dodecyldiphenyl ether disulfonate aqueous solution (ELEMINOL MON-7, manufactured by Sanyo Chemical Industries, Ltd.), and 90 parts by mass of ethyl acetate were mixed together and stirred, to thereby obtain a milky white fluid, which was used as Aqueous Phase 1.

—Synthesis of Non-Crystalline Low-Molecular Polyester—

A reaction vessel equipped with a cooling tube, a stirrer, and a nitrogen-inlet tube was charged with 229 parts by mass of bisphenol A ethylene oxide (2 mol) adduct, 339 parts by mass of bisphenol A propylene oxide (3 mol) adduct, 208 parts by mass of terephthalic acid, 80 parts by mass of adipic acid, 10 parts by mass of succinic acid, and 2 parts by mass of dibutyl tin oxide, and the resulting mixture was allowed to react for 5 hours at 230° C. under the atmospheric pressure, and further reacted for 5 hours under the reduced pressure of 10 mmHg to 15 mmHg. Thereafter, to the reaction vessel, 35 parts by mass of trimellitic anhydride was added, and the resulting mixture was allowed to react for 1 hour at 180° C. under the atmospheric pressure, to thereby obtain Non-Crystalline Low-Molecular Polyester 1.

—Synthesis of Non-Crystalline Intermediate Polyester—

A reaction vessel equipped with a cooling tube, a stirrer, and a nitrogen-inlet tube was charged with 682 parts by mass of bisphenol A ethylene oxide (2 mol) adduct, 81 parts by mass of bisphenol A propylene oxide (2 mol) adduct, 283 parts by mass of terephthalic acid, 22 parts by mass of trimellitic anhydride, and 2 parts by mass of dibutyl tin oxide, and the resulting mixture was allowed to react for 7 hours at 230° C. under the atmospheric pressure, and further reacted for 5 hours under the reduced pressure of 10 mmHg to 15 mmHg, to thereby obtain Intermediate Polyester 1.

Next, a reaction vessel equipped with a cooling tube, a stirrer, and a nitrogen-inlet tube was charged with 410 parts by mass of Intermediate Polyester 1, 89 parts by mass of isophorone diisocyanate, and 500 parts by mass of ethyl acetate, and the resulting mixture was allowed to react for 5 hours at 100° C., to thereby obtain Prepolymer 1.

—Synthesis of Ketimine—

A reaction vessel equipped with a stirring bar and a thermometer was charged with 170 parts by mass of isophorone diamine, and 75 parts by mass of methyl ethyl ketone, and the mixture was allowed to react for 4 and a half hours at 50° C., to thereby obtain Ketimine Compound 1.

—Synthesis of Crystalline Polyester Resin—

A reaction vessel equipped with a cooling tube, a stirrer, and a nitrogen-inlet tube was charged with 1,200 parts by mass of 1,6-hexanediol, 1,200 parts by mass of decanedioic acid, 0.4 parts by mass of dibutyl tin oxide serving as a catalyst. Thereafter, the air inside the vessel was turned into an inert atmosphere with nitrogen gas by decompression, and the mixture in the vessel was mechanically stirred for 4 hours at 180 rpm. Thereafter, the resultant was heated to 210° C. under the reduced pressure, followed by stirring for 1.5 hours. Once the mixture became viscous, the mixture was air-cooled to stop the reaction, to thereby obtain Crystalline Polyester 1.

—Preparation of Oil Phase—

A vessel equipped with a stirring bar and a thermometer was charged with 600 parts by mass of Non-Crystalline Low-Molecular Polyester 1, 120 parts by mass of paraffin wax (melting point: 90° C.), 596 parts by mass of Crystalline Polyester 1, and 1,894 parts by mass of ethyl acetate, and the resulting mixture was heated to 80° C. with stirring. The temperature was kept at 80° C. for 5 hours, followed by cooling the mixture to 30° C. over 1 hour. Next, the vessel was further charged with 250 parts by mass of carbon black (Printex35, manufactured by Evonik Degussa Japan Co., Ltd.) [DBP oil absorption value=42 ml/100 mg, pH=9.5], and 1,000 parts by mass of ethyl acetate, and the resulting mixture was mixed for 1 hour, to thereby obtain Raw Material Solution 1.

Raw Material Solution 1 (1,324 parts by mass) was transferred to another vessel, and the carbon black and wax therein were dispersed by means of a bead mill (ULTRA VISCOMILL, manufactured by AIMEX CO., Ltd.) under the conditions: a liquid feed rate of 1 kg/hr, disk circumferential velocity of 6 m/sec, 0.5 mm-zirconia beads packed to 80% by volume, and 5 passes, to thereby obtain Pigment-Wax Dispersion Liquid 1.

—Emulsification and Removal of Solvent—

A vessel was charged with 749 parts by mass of Pigment-Wax Dispersion Liquid 1, 120 parts by mass of Prepolymer 1, and 3.5 parts by mass of Ketimine Compound 1, and the resulting mixture was mixed by TK Homomixer (manufactured by PRIMIX Corporation) at 5,000 rpm for 5 minutes. To the vessel, 1,200 parts by mass of Aqueous Phase 1 was added, and the resulting mixture was mixed by TK Homomixer at 10,000 rpm for 1.5 hours, to thereby obtain Emulsified Slurry 1.

A vessel equipped with a stirrer and a thermometer was charged with Emulsified Slurry 1, and the solvent therein was removed at 30° C. for 8 hours, followed by maturing at 40° C. for 72 hours, to thereby obtain Dispersion Slurry 1.

—Washing and Drying—

After filtering 100 parts by mass of Dispersion Slurry 1 under the reduced pressure, the following series of operations (1) to (4) was performed twice, to thereby obtain Filtration Cake 1.

(1): To the filtration cake, 100 parts by mass of ion-exchanged water was added, and the mixture was mixed (at 12,000 rpm for 10 minutes) by the TK Homomixer, followed by filtering the mixture.

(2): To the filtration cake obtained in (1), 100 parts by mass of a 10% by mass sodium hydroxide aqueous solution was added, and the mixture was mixed (at 12,000 rpm for 30 minutes) by the TK Homomixer, followed by filtering the mixture under the reduced pressure.

(3): To the filtration cake obtained in (2), 100 parts by mass of 10% by mass hydrochloric acid was added, and the mixture was mixed (at 12,000 rpm for 10 minutes) by the TK Homomixer, followed by filtering the mixture.

(4): To the filtration cake obtained in (3), 300 parts by mass of ion-exchanged water was added, and the mixture was mixed (at 12,000 rpm for 10 minutes) by the TK Homomixer, followed by filtering the mixture.

Filtration Cake 1 was dried with an air-circulating drier for 48 hours at 45° C., and was then passed through a sieve with a mesh size of 75 μm, to thereby prepare Toner Base Particles 1.

Thereafter, 100 parts by mass of Toner Base Particles 1 and 1 part of hydrophobic silica having a diameter of 13 nm were mixed by HENSCHEL MIXER, to thereby obtain a toner. The properties of the obtained toner are presented in Table 1, and the evaluation results thereof are presented in Table 2.

Example 2

A toner was obtained in the same manner as in Example 1, provided that Raw Material Solution 2 described below was used as the raw material solution, Pigment-Wax Dispersion Liquid 2 described below was used as the pigment-wax dispersion solution, Emulsified Slurry 2 described below was used as the emulsified slurry, Dispersion Slurry 2 described below was used as the dispersion slurry, Filtration Cake 2 described below was used as the filtration cake, and Toner Base Particles 2 described below were used as the toner base particles. The properties of the obtained toner are presented in Table 1, and the evaluation results thereof are presented in Table 2.

—Preparation of Oil Phase—

A vessel equipped with a stirring bar and a thermometer was charged with 740 parts by mass of Non-Crystalline Low-Molecular Polyester 1, 120 parts by mass of paraffin wax (melting point: 90° C.), 456 parts by mass of Crystalline Polyester 1, and 1,894 parts by mass of ethyl acetate, and the resulting mixture was heated to 80° C. with stirring. The temperature was kept at 80° C. for 5 hours, followed by cooling the mixture to 30° C. over 1 hour. Next, the vessel was further charged with 250 parts by mass of carbon black (Printex35, manufactured by Evonik Degussa Japan Co., Ltd.) [DBP oil absorption value=42 ml/100 mg, pH=9.5], and 1,000 parts by mass of ethyl acetate, and the resulting mixture was mixed for 1 hour, to thereby obtain Raw Material Solution 2.

Raw Material Solution 2 (1,324 parts by mass) was transferred to another vessel, and the carbon black and wax therein were dispersed by means of a bead mill (ULTRA VISCOMILL, manufactured by AIMEX CO., Ltd.) under the conditions: a liquid feed rate of 1 kg/hr, disk circumferential velocity of 6 m/sec, 0.5 mm-zirconia beads packed to 80% by volume, and 5 passes, to thereby obtain Pigment-Wax Dispersion Liquid 2.

—Emulsification and Removal of Solvent—

A vessel was charged with 749 parts by mass of Pigment-Wax Dispersion Liquid 2, 130 parts by mass of Prepolymer 1, and 3.8 parts by mass of Ketimine Compound 1, and the resulting mixture was mixed by TK Homomixer (manufactured by PRIMIX Corporation) at 5,000 rpm for 5 minutes. To the vessel, 1,200 parts by mass of Aqueous Phase 1 was added, and the resulting mixture was mixed by TK Homomixer at 10,000 rpm for 1.5 hours, to thereby obtain Emulsified Slurry 2.

A vessel equipped with a stirrer and a thermometer was charged with Emulsified Slurry 2, and the solvent therein was removed at 30° C. for 8 hours, followed by maturing at 40° C. for 72 hours, to thereby obtain Dispersion Slurry 2.

—Washing and Drying—

After filtering 100 parts by mass of Dispersion Slurry 2 under the reduced pressure, the following series of operations (1) to (4) was performed twice, to thereby obtain Filtration Cake 2.

(1): To the filtration cake, 100 parts by mass of ion-exchanged water was added, and the mixture was mixed (at 12,000 rpm for 10 minutes) by the TK Homomixer, followed by filtering the mixture.

(2): To the filtration cake obtained in (1), 100 parts by mass of a 10% by mass sodium hydroxide aqueous solution was added, and the mixture was mixed (at 12,000 rpm for 30 minutes) by the TK Homomixer, followed by filtering the mixture under the reduced pressure.

(3): To the filtration cake obtained in (2), 100 parts by mass of 10% by mass hydrochloric acid was added, and the mixture was mixed (at 12,000 rpm for 10 minutes) by the TK Homomixer, followed by filtering the mixture.

(4): To the filtration cake obtained in (3), 300 parts by mass of ion-exchanged water was added, and the mixture was mixed (at 12,000 rpm for 10 minutes) by the TK Homomixer, followed by filtering the mixture.

Filtration Cake 2 was dried with an air-circulating drier for 48 hours at 45° C., and was then passed through a sieve with a mesh size of 75 μm, to thereby prepare Toner Base Particles 2.

Thereafter, 100 parts by mass of Toner Base Particles 2 and 1 part of hydrophobic silica having a diameter of 13 nm were mixed by HENSCHEL MIXER, to thereby obtain a toner. The properties of the obtained toner are presented in Table 1, and the evaluation results thereof are presented in Table 2.

Example 3

A toner was obtained in the same manner as in Example 1, provided that Raw Material Solution 3 described below was used as the raw material solution, Pigment-Wax Dispersion Liquid 3 described below was used as the pigment-wax dispersion solution, Emulsified Slurry 3 described below was used as the emulsified slurry, Dispersion Slurry 3 described below was used as the dispersion slurry, Filtration Cake 3 described below was used as the filtration cake, and Toner Base Particles 3 described below were used as the toner base particles. The properties of the obtained toner are presented in Table 1, and the evaluation results thereof are presented in Table 2.

—Preparation of Oil Phase—

A vessel equipped with a stirring bar and a thermometer was charged with 300 parts by mass of Non-Crystalline Low-Molecular Polyester 1, 120 parts by mass of paraffin wax (melting point: 90° C.), 896 parts by mass of Crystalline Polyester 1, and 1,894 parts by mass of ethyl acetate, and the resulting mixture was heated to 80° C. with stirring. The temperature was kept at 80° C. for 5 hours, followed by cooling the mixture to 30° C. over 1 hour. Next, the vessel was further charged with 250 parts by mass of carbon black (Printex35, manufactured by Evonik Degussa Japan Co., Ltd.) [DBP oil absorption value=42 ml/100 mg, pH=9.5], and 1,000 parts by mass of ethyl acetate, and the resulting mixture was mixed for 1 hour, to thereby obtain Raw Material Solution 3.

Raw Material Solution 3 (1,324 parts by mass) was transferred to another vessel, and the carbon black and wax therein were dispersed by means of a bead mill (ULTRA VISCOMILL, manufactured by AIMEX CO., Ltd.) under the conditions: a liquid feed rate of 1 kg/hr, disk circumferential velocity of 6 m/sec, 0.5 mm-zirconia beads packed to 80% by volume, and 5 passes, to thereby obtain Pigment-Wax Dispersion Liquid 3.

—Emulsification and Removal of Solvent—

A vessel was charged with 749 parts by mass of Pigment-Wax Dispersion Liquid 3, 130 parts by mass of Prepolymer 1, and 3.8 parts by mass of Ketimine Compound 1, and the resulting mixture was mixed by TK Homomixer (manufactured by PRIMIX Corporation) at 5,000 rpm for 5 minutes. To the vessel, 1,200 parts by mass of Aqueous Phase 1 was added, and the resulting mixture was mixed by TK Homomixer at 10,000 rpm for 1.5 hours, to thereby obtain Emulsified Slurry 3.

A vessel equipped with a stirrer and a thermometer was charged with Emulsified Slurry 3, and the solvent therein was removed at 30° C. for 8 hours, followed by maturing at 40° C. for 72 hours, to thereby obtain Dispersion Slurry 3.

—Washing and Drying—

After filtering 100 parts by mass of Dispersion Slurry 3 under the reduced pressure, the following series of operations (1) to (4) was performed twice, to thereby obtain Filtration Cake 3.

(1): To the filtration cake, 100 parts by mass of ion-exchanged water was added, and the mixture was mixed (at 12,000 rpm for 10 minutes) by the TK Homomixer, followed by filtering the mixture.

(2): To the filtration cake obtained in (1), 100 parts by mass of a 10% by mass sodium hydroxide aqueous solution was added, and the mixture was mixed (at 12,000 rpm for 30 minutes) by the TK Homomixer, followed by filtering the mixture under the reduced pressure.

(3): To the filtration cake obtained in (2), 100 parts by mass of 10% by mass hydrochloric acid was added, and the mixture was mixed (at 12,000 rpm for 10 minutes) by the TK Homomixer, followed by filtering the mixture.

(4): To the filtration cake obtained in (3), 300 parts by mass of ion-exchanged water was added, and the mixture was mixed (at 12,000 rpm for 10 minutes) by the TK Homomixer, followed by filtering the mixture.

Filtration Cake 3 was dried with an air-circulating drier for 48 hours at 45° C., and was then passed through a sieve with a mesh size of 75 μm, to thereby prepare Toner Base Particles 3.

Thereafter, 100 parts by mass of Toner Base Particles 3 and 1 part of hydrophobic silica having a diameter of 13 nm were mixed by HENSCHEL MIXER, to thereby obtain a toner. The properties of the obtained toner are presented in Table 1, and the evaluation results thereof are presented in Table 2.

Example 4

A toner was obtained in the same manner as in Example 1, provided that Raw Material Solution 2 described above was used as the raw material solution, Pigment-Wax Dispersion Liquid 2 described above was used as the pigment-wax dispersion solution, Emulsified Slurry 4 described below was used as the emulsified slurry, Dispersion Slurry 4 described below was used as the dispersion slurry, Filtration Cake 4 described below was used as the filtration cake, and Toner Base Particles 4 described below were used as the toner base particles. The properties of the obtained toner are presented in Table 1, and the evaluation results thereof are presented in Table 2.

—Emulsification and Removal of Solvent—

A vessel was charged with 749 parts by mass of Pigment-Wax Dispersion Liquid 2, 110 parts by mass of Prepolymer 1, and 3.2 parts by mass of Ketimine Compound 1, and the resulting mixture was mixed by TK Homomixer (manufactured by PRIMIX Corporation) at 5,000 rpm for 5 minutes. To the vessel, 1,200 parts by mass of Aqueous Phase 1 was added, and the resulting mixture was mixed by TK Homomixer at 10,000 rpm for 1.5 hours, to thereby obtain Emulsified Slurry 4.

A vessel equipped with a stirrer and a thermometer was charged with Emulsified Slurry 4, and the solvent therein was removed at 30° C. for 8 hours, followed by maturing at 40° C. for 72 hours, to thereby obtain Dispersion Slurry 4.

—Washing and Drying—

After filtering 100 parts by mass of Dispersion Slurry 4 under the reduced pressure, the following series of operations (1) to (4) was performed twice, to thereby obtain Filtration Cake 4.

(1): To the filtration cake, 100 parts by mass of ion-exchanged water was added, and the mixture was mixed (at 12,000 rpm for 10 minutes) by the TK Homomixer, followed by filtering the mixture.

(2): To the filtration cake obtained in (1), 100 parts by mass of a 10% by mass sodium hydroxide aqueous solution was added, and the mixture was mixed (at 12,000 rpm for 30 minutes) by the TK Homomixer, followed by filtering the mixture under the reduced pressure.

(3): To the filtration cake obtained in (2), 100 parts by mass of 10% by mass hydrochloric acid was added, and the mixture was mixed (at 12,000 rpm for 10 minutes) by the TK Homomixer, followed by filtering the mixture.

(4): To the filtration cake obtained in (3), 300 parts by mass of ion-exchanged water was added, and the mixture was mixed (at 12,000 rpm for 10 minutes) by the TK Homomixer, followed by filtering the mixture.

Filtration Cake 4 was dried with an air-circulating drier for 48 hours at 45° C., and was then passed through a sieve with a mesh size of 75 μm, to thereby prepare Toner Base Particles 4.

Thereafter, 100 parts by mass of Toner Base Particles 4 and 1 part of hydrophobic silica having a diameter of 13 nm were mixed by HENSCHEL MIXER, to thereby obtain a toner. The properties of the obtained toner are presented in Table 1, and the evaluation results thereof are presented in Table 2.

Example 5

A toner was obtained in the same manner as in Example 1, provided that Raw Material Solution 3 described above was used as the raw material solution, Pigment-Wax Dispersion Liquid 3 described above was used as the pigment-wax dispersion solution, Emulsified Slurry 5 described below was used as the emulsified slurry, Dispersion Slurry 5 described below was used as the dispersion slurry, Filtration Cake 5 described below was used as the filtration cake, and Toner Base Particles 5 described below were used as the toner base particles. The properties of the obtained toner are presented in Table 1, and the evaluation results thereof are presented in Table 2.

—Emulsification and Removal of Solvent—

A vessel was charged with 749 parts by mass of Pigment-Wax Dispersion Liquid 3, 110 parts by mass of Prepolymer 1, and 3.2 parts by mass of Ketimine Compound 1, and the resulting mixture was mixed by TK Homomixer (manufactured by PRIMIX Corporation) at 5,000 rpm for 5 minutes. To the vessel, 1,200 parts by mass of Aqueous Phase 1 was added, and the resulting mixture was mixed by TK Homomixer at 10,000 rpm for 1.5 hours, to thereby obtain Emulsified Slurry 5.

A vessel equipped with a stirrer and a thermometer was charged with Emulsified Slurry 5, and the solvent therein was removed at 30° C. for 8 hours, followed by maturing at 40° C. for 72 hours, to thereby obtain Dispersion Slurry 5.

—Washing and Drying—

After filtering 100 parts by mass of Dispersion Slurry 5 under the reduced pressure, the following series of operations (1) to (4) was performed twice, to thereby obtain Filtration Cake 5.

(1): To the filtration cake, 100 parts by mass of ion-exchanged water was added, and the mixture was mixed (at 12,000 rpm for 10 minutes) by the TK Homomixer, followed by filtering the mixture.

(2): To the filtration cake obtained in (1), 100 parts by mass of a 10% by mass sodium hydroxide aqueous solution was added, and the mixture was mixed (at 12,000 rpm for 30 minutes) by the TK Homomixer, followed by filtering the mixture under the reduced pressure.

(3): To the filtration cake obtained in (2), 100 parts by mass of 10% by mass hydrochloric acid was added, and the mixture was mixed (at 12,000 rpm for 10 minutes) by the TK Homomixer, followed by filtering the mixture.

(4): To the filtration cake obtained in (3), 300 parts by mass of ion-exchanged water was added, and the mixture was mixed (at 12,000 rpm for 10 minutes) by the TK Homomixer, followed by filtering the mixture.

Filtration Cake 5 was dried with an air-circulating drier for 48 hours at 45° C., and was then passed through a sieve with a mesh size of 75 μm, to thereby prepare Toner Base Particles 5.

Thereafter, 100 parts by mass of Toner Base Particles 5 and 1 part of hydrophobic silica having a diameter of 13 nm were mixed by HENSCHEL MIXER, to thereby obtain a toner. The properties of the obtained toner are presented in Table 1, and the evaluation results thereof are presented in Table 2.

Example 6

A toner was obtained in the same manner as in Example 1, provided that Emulsified Slurry 6 described below was used as the emulsified slurry, Dispersion Slurry 6 described below was used as the dispersion slurry, Filtration Cake 6 described below was used as the filtration cake, and Toner Base Particles 6 described below were used as the toner base particles. The properties of the obtained toner are presented in Table 1, and the evaluation results thereof are presented in Table 2.

—Emulsification and Removal of Solvent—

A vessel was charged with 749 parts by mass of Pigment-Wax Dispersion Liquid 1, 120 parts by mass of Prepolymer 1, and 3.5 parts by mass of Ketimine Compound 1, and the resulting mixture was mixed by TK Homomixer (manufactured by PRIMIX Corporation) at 5,000 rpm for 15 minutes. To the vessel, 1,200 parts by mass of Aqueous Phase 1 was added, and the resulting mixture was mixed by TK Homomixer at 10,000 rpm for 1.5 hours, to thereby obtain Emulsified Slurry 6.

A vessel equipped with a stirrer and a thermometer was charged with Emulsified Slurry 6, and the solvent therein was removed at 30° C. for 8 hours, followed by maturing at 40° C. for 72 hours, to thereby obtain Dispersion Slurry 6.

—Washing and Drying—

After filtering 100 parts by mass of Dispersion Slurry 6 under the reduced pressure, the following series of operations (1) to (4) was performed twice, to thereby obtain Filtration Cake 6.

(1): To the filtration cake, 100 parts by mass of ion-exchanged water was added, and the mixture was mixed (at 12,000 rpm for 10 minutes) by the TK Homomixer, followed by filtering the mixture.

(2): To the filtration cake obtained in (1), 100 parts by mass of a 10% by mass sodium hydroxide aqueous solution was added, and the mixture was mixed (at 12,000 rpm for 30 minutes) by the TK Homomixer, followed by filtering the mixture under the reduced pressure.

(3): To the filtration cake obtained in (2), 100 parts by mass of 10% by mass hydrochloric acid was added, and the mixture was mixed (at 12,000 rpm for 10 minutes) by the TK Homomixer, followed by filtering the mixture.

(4): To the filtration cake obtained in (3), 300 parts by mass of ion-exchanged water was added, and the mixture was mixed (at 12,000 rpm for 10 minutes) by the TK Homomixer, followed by filtering the mixture.

Filtration Cake 6 was dried with an air-circulating drier for 48 hours at 45° C., and was then passed through a sieve with a mesh size of 75 μm, to thereby prepare Toner Base Particles 6.

Thereafter, 100 parts by mass of Toner Base Particles 6 and 1 part of hydrophobic silica having a diameter of 13 nm were mixed by HENSCHEL MIXER, to thereby obtain a toner. The properties of the obtained toner are presented in Table 1, and the evaluation results thereof are presented in Table 2.

Example 7

Production of Urethane-Modified Crystalline Polyester Resin

A reaction vessel equipped with a cooling tube, a stirrer, and a nitrogen-inlet tube was charged with 202 parts by mass (1.00 mol) of sebacic acid, 15 parts by mass (0.10 mol) of adipic acid, 177 parts by mass (1.50 mol) of 1,6-hexanediol, and 0.5 parts by mass of tetrabutoxy titanate serving as a condensation catalyst, and the resulting mixture was allowed to react under a flow of nitrogen gas at 180° C. for 8 hours while removing the generated water. Next, the mixture was gradually heated to 220° C., while removing the generated water and 1,6-hexanediol under the flow of nitrogen, to thereby react for 4 hours, followed by further reacting under the reduced pressure of 5 mmHg to 20 mmHg until the weight average molecular weight Mw of the reaction product reached about 12,000, to thereby obtain Crystalline Polyester Resin 7'. Crystalline Polyester Resin 7' had the weight average molecular weight Mw of 12,000.

Subsequently, Crystalline Polyester Resin 7' was transferred into a reaction vessel equipped with a cooling tube, a stirrer, and a nitrogen-inlet tube. To this, 350 parts by mass of ethyl acetate, and 35 parts by mass (0.14 mol) of 4,4'-diphenylmethane diisocyanate (MDI) were added, and the resulting mixture was allowed to react for 5 hours at 80° C. under a flow of nitrogen. Next, the ethyl acetate was removed under the reduced pressure, to thereby obtain Urethane-Modified Crystalline Polyester Resin 7.

—Production of Non-Crystalline Resin—

A reaction vessel equipped with a cooling tube, a stirrer, and a nitrogen-inlet tube was charged with 222 parts by mass of bisphenol A EO (2 mol) adduct, 129 parts by mass of bisphenol A PO (2 mol) adduct, 166 parts by mass of isophthalic acid, and 0.5 parts by mass of tetrabutoxy titanate, and the resulting mixture was allowed to react for 8 hours at 230° C. under a flow of nitrogen and the atmospheric pressure, while removing the generated water. Subsequently, the resultant was allowed to react under the reduced pressure of 5 mmHg to 20 mmHg. Once the acid value of the resultant became 2, it was cooled to 180° C. To this, 35 parts by mass of trimerittic anhydride, and a resulting mixture was allowed to react for 3 hours under the atmospheric pressure, to thereby obtain Non-Crystalline Resin 7.

—Production of Graft Polymer—

A reaction vessel equipped with a stirring bar and a thermometer was charged with 480 parts by mass of xylene, and 100 parts by mass of low molecular weight polyethylene (SANWAX LEL-400, manufactured by Sanyo Chemical Industries, Ltd., softening point: 128° C.), and the low molecular weight polyethylene was sufficiently dissolved in the xylene. After pursing with nitrogen, a mixed solution containing 740 parts by mass of styrene, 100 parts by mass of acrylonitrile, 60 parts by mass of butyl acrylate, 36 parts by mass of di-t-butylperoxyhexahydroterephthalate, and 100 parts by mass of xylene was added dropwise at 170° C. over 3 hours, and the resulting mixture was maintained at this temperature for 30 minutes. Subsequently, the solvent was removed therefrom, to thereby synthesize Graft Polymer.

—Preparation of Releasing Agent Dispersion Liquid—

A vessel equipped with a stirring bar and a thermometer was charged with 50 parts by mass of paraffin wax (HNP-9, manufactured by NIPPON SEIRO CO., LTD., hydrocarbon-based wax, melting point: 75° C., SP value: 8.8), 30 parts by mass of Graft Polymer, and 420 parts by mass of ethyl acetate, and the resulting mixture was heated to 80° C. with stirring. The temperature was kept at 80° C. for 5 hours, followed by cooling the mixture to 30° C. over 1 hour. The resultant was dispersed by means of a bead mill (ULTRA VISCOMILL, manufactured by AIMEX CO., Ltd.) under the conditions: a liquid feed rate of 1 kg/hr, disk circumferential velocity of 6 m/sec, 0.5 mm-zirconia beads packed to 80% by volume, and 3 passes, to thereby obtain Releasing Agent Dispersion Liquid.

—Production of Master Batch—

| | |
|---|---|
| Urethane-Modified Crystalline Polyester Resin 7 | 100 parts by mass |
| Carbon black (Printex35, manufactured by Evonik Degussa Japan Co., Ltd.) (DBP oil absorption value: 42 mL/100 g, pH: 9.5) | 100 parts by mass |
| Ion-exchanged water | 50 parts by mass |

The above-listed rat materials were mixed by means of HENSCHEL MIXER (manufactured by Nippon Cole & Engineering Co., Ltd.). The obtained mixture was kneaded by a two-roll mill. As for the kneading temperature, the kneading was started at 90° C., followed by gradually cooling to 50° C. The obtained kneaded product was pulverized by a pulverizer (manufactured by Hosokawa Micron Corporation), to thereby produce Master Batch 7.

—Production of Oil Phase—

A vessel equipped with a thermometer and a stirrer was charged with 62 parts by mass of Urethane-Modified Crystalline Polyester Resin 7. To this, ethyl acetate was added in an amount that made the solid content of the mixture 50% by mass, and the resulting mixture was heated to the temperature equal to or higher than the melting point of the resin to sufficiently dissolve the resin. To this, 60 parts by mass of 50% by mass Non-Crystalline Resin 7 ethyl acetate solution, 60 parts by mass of Releasing Agent Dispersion Liquid, and 16 parts of Master Batch 7 were added, and the resulting mixture was stirred by TK Homomixer (manufactured by PRIMIX Corporation) at 5,000 rpm and 50° C., to homogeneously dissolve and disperse the contents, to thereby obtain Pigment-Wax Dispersion Liquid 7. Note that, the temperature of Pigment-Wax Dispersion Liquid 7 in the vessel was maintained at 50° C., and Pigment-Wax Dispersion Liquid 7 was used within 5 hours from the production thereof so as not to be crystallized.

—Production of Aqueous Dispersion Liquid of Resin Particles—

A reaction vessel equipped with a stirring bar and a thermometer was charged with 600 parts by mass of water, 120 parts by mass of styrene, 100 parts by mass of methacrylic acid, 45 parts by mass of butyl acrylate, 10 parts by mass of sodium alkylallyl sulfosuccinate (ELEMINOL JS-2, manufactured by Sanyo Chemical Industries, Ltd.), 1 part by mass of ammonium persulfate, and the resulting mixture was stirred for 20 minutes at 400 rpm, to thereby obtain a white emulsion. The obtained emulsion was heated until the internal system temperature reached 75° C., and was allowed to react for 6 hours. A 1% by mass aqueous ammonium persulfate solution (30 parts) was further added to the reaction mixture, followed by aging for 6 hours at 75° C., to thereby obtain Aqueous Dispersion Liquid of Resin Particles.

—Preparation of Aqueous Phase—

Water (990 parts by mass), 83 parts by mass of Aqueous Dispersion Liquid of Resin Particles, 37 parts by mass of a 48.5% sodium dodecyldiphenyl ether disulfonate aqueous solution (ELEMINOL MON-7, manufactured by Sanyo Chemical Industries, Ltd.), and 90 parts by mass of ethyl acetate were mixed together and stirred, to thereby obtain Aqueous Phase 7.

—Production of Toner—

Aqueous Phase 7 (520 parts by mass) was placed into another vessel equipped with a stirrer and a thermometer, and was heated to 40° C. While stirring Aqueous Phase 7 by TK Homomixer (manufactured by PRIMIX Corporation) at 13,000 rpm with maintaining the temperature thereof in the range of 40° C. to 50° C., 260 parts by mass of Pigment-Wax Dispersion Liquid 7 temperature of which had been kept at 50° C. was added thereto, and the mixture was emulsified over 1 minute, to thereby obtain Emulsified Slurry 7. Subsequently, a vessel equipped with a stirrer and a thermometer was charged with Emulsified Slurry 7, and the solvent therein was removed at 60° C. for 6 hours, to thereby obtain Dispersion Slurry 7. After filtering Dispersion Slurry 7 under the reduced pressure, the following washing treatment was performed.

(1): To the filtration cake, 100 parts by mass of ion-exchanged water was added, and the mixture was mixed (at 6,000 rpm for 5 minutes) by the TK Homomixer, followed by filtering the mixture.

(2): To the filtration cake obtained in (1), 100 parts by mass of a 10% by mass sodium hydroxide aqueous solution was added, and the mixture was mixed (at 6,000 rpm for 10 minutes) by the TK Homomixer, followed by filtering the mixture under the reduced pressure.

(3): To the filtration cake obtained in (2), 100 parts by mass of 10% by mass hydrochloric acid was added, and the mixture was mixed (at 6,000 rpm for 5 minutes) by the TK Homomixer, followed by filtering the mixture.

(4): To the filtration cake obtained in (3), 300 parts by mass of ion-exchanged water was added, and the mixture was mixed (at 6,000 rpm for 5 minutes) by the TK Homomixer, followed by filtering the mixture.

As for the washing treatment, a series of the operations (1) to (4) was performed twice, to thereby obtain Filtration Cake 7. Filtration Cake 7 was dried with an air-circulating drier for 48 hours at 45° C., and was then passed through a sieve with a mesh size of 75 μm, to thereby prepare Toner Base Particles 7. Thereafter, 100 parts by mass of Toner Base Particles 7 and 1 part of hydrophobic silica having a diameter of 13 nm were mixed by HENSCHEL MIXER, to thereby obtain a toner. The properties of the obtained toner are presented in Table 1, and the evaluation results thereof are presented in Table 2.

Example 8

A toner was obtained in the same manner as in Example 7, provided that Urethane-Modified Crystalline Polyester Resin 8 described below was used as the urethane-modified crystalline polyester resin, Master Batch 8 described below was used as the master batch, Pigment-Wax Dispersion Liquid 8 described below was used as the pigment-wax dispersion liquid, Emulsified Slurry 8 described below was used as the emulsified slurry, Dispersion Slurry 8 described below was used as the dispersion slurry, Filtration Cake 8 described below was used as the filtration cake, and Toner Base Particles 8 were used as the toner base particles. The properties of the obtained toner are presented in Table 1, and the evaluation results thereof are presented in Table 2.

—Production of Urethane-Modified Crystalline Polyester Resin—

A reaction vessel equipped with a cooling tube, a stirrer, and a nitrogen-inlet tube was charged with 202 parts by mass (1.00 mol) of sebacic acid, 15 parts by mass (0.10 mol) of adipic acid, 177 parts by mass (1.50 mol) of 1,6-hexanediol, and 0.5 parts by mass of tetrabutoxy titanate serving as a condensation catalyst, and the resulting mixture was allowed to react under a flow of nitrogen gas at 180° C. for 8 hours while removing the generated water. Next, the mixture was gradually heated to 220° C., while removing the generated water and 1,6-hexanediol under the flow of nitrogen, to thereby react for 4 hours, followed by further reacting under the reduced pressure of 5 mmHg to 20 mmHg until the weight average molecular weight Mw of the reaction product reached about 12,000, to thereby obtain Crystalline Polyester Resin 7'. Crystalline Polyester Resin 7' had the weight average molecular weight Mw of 12,000.

Subsequently, Crystalline Polyester Resin 7' was transferred into a reaction vessel equipped with a cooling tube, a stirrer, and a nitrogen-inlet tube. To this, 350 parts by mass of ethyl acetate, and 40 parts by mass (0.16 mol) of 4,4'-diphenylmethane diisocyanate (MDI) were added, and the resulting mixture was allowed to react for 5 hours at 80° C. under a flow of nitrogen. Next, the ethyl acetate was removed under the reduced pressure, to thereby obtain Urethane-Modified Crystalline Polyester Resin 8.

—Production of Master Batch—

| | |
|---|---|
| Urethane-Modified Crystalline Polyester Resin 8 | 100 parts by mass |
| Carbon black (Printex35, manufactured by Evonik Degussa Japan Co., Ltd.) (DBP oil absorption value: 42 mL/100 g, pH: 9.5) | 100 parts by mass |
| Ion-exchanged water | 50 parts by mass |

The above-listed rat materials were mixed by means of HENSCHEL MIXER (manufactured by Nippon Cole &

Engineering Co., Ltd.). The obtained mixture was kneaded by a two-roll mill. As for the kneading temperature, the kneading was started at 90° C., followed by gradually cooling to 50° C. The obtained kneaded product was pulverized by a pulverizer (manufactured by Hosokawa Micron Corporation), to thereby produce Master Batch 8.

—Production of Oil Phase—

A vessel equipped with a thermometer and a stirrer was charged with 42 parts by mass of Urethane-Modified Crystalline Polyester Resin 8. To this, ethyl acetate was added in an amount that made the solid content of the mixture 50% by mass, and the resulting mixture was heated to the temperature equal to or higher than the melting point of the resin to sufficiently dissolve the resin. To this, 100 parts by mass of 50% by mass Non-Crystalline Resin 7 ethyl acetate solution, 60 parts by mass of Releasing Agent Dispersion Liquid, and 16 parts of Master Batch 8 were added, and the resulting mixture was stirred by TK Homomixer (manufactured by PRIMIX Corporation) at 5,000 rpm and 50° C., to homogeneously dissolve and disperse the contents, to thereby obtain Pigment-Wax Dispersion Liquid 8. Note that, the temperature of Pigment-Wax Dispersion Liquid 8 in the vessel was maintained at 50° C., and Pigment-Wax Dispersion Liquid 8 was used within 5 hours from the production thereof so as not to be crystallized.

—Production of Toner—

Aqueous Phase 7 (520 parts by mass) was placed into another vessel equipped with a stirrer and a thermometer, and was heated to 40° C. While stirring Aqueous Phase 7 by TK Homomixer (manufactured by PRIMIX Corporation) at 13,000 rpm with maintaining the temperature thereof in the range of 40° C. to 50° C., 260 parts by mass of Pigment-Wax Dispersion Liquid 8 temperature of which had been kept at 50° C. was added thereto, and the mixture was emulsified over 1 minute, to thereby obtain Emulsified Slurry 8. Subsequently, a vessel equipped with a stirrer and a thermometer was charged with Emulsified Slurry 8, and the solvent therein was removed at 60° C. for 6 hours, to thereby obtain Dispersion Slurry 8. After filtering Dispersion Slurry 8 under the reduced pressure, the following washing treatment was performed.

(1): To the filtration cake, 100 parts by mass of ion-exchanged water was added, and the mixture was mixed (at 6,000 rpm for 5 minutes) by the TK Homomixer, followed by filtering the mixture.

(2): To the filtration cake obtained in (1), 100 parts by mass of a 10% by mass sodium hydroxide aqueous solution was added, and the mixture was mixed (at 6,000 rpm for 10 minutes) by the TK Homomixer, followed by filtering the mixture under the reduced pressure.

(3): To the filtration cake obtained in (2), 100 parts by mass of 10% by mass hydrochloric acid was added, and the mixture was mixed (at 6,000 rpm for 5 minutes) by the TK Homomixer, followed by filtering the mixture.

(4): To the filtration cake obtained in (3), 300 parts by mass of ion-exchanged water was added, and the mixture was mixed (at 6,000 rpm for 5 minutes) by the TK Homomixer, followed by filtering the mixture.

As for the washing treatment, a series of the operations (1) to (4) was performed twice, to thereby obtain Filtration Cake 8. Filtration Cake 8 was dried with an air-circulating drier for 48 hours at 45° C., and was then passed through a sieve with a mesh size of 75 μm, to thereby prepare Toner Base Particles 8. Thereafter, 100 parts by mass of Toner Base Particles 8 and 1 part of hydrophobic silica having a diameter of 13 nm were mixed by HENSCHEL MIXER, to thereby obtain a toner. The properties of the obtained toner are presented in Table 1, and the evaluation results thereof are presented in Table 2.

Example 9

A toner was obtained in the same manner as in Example 7, provided that Urethane-Modified Crystalline Polyester Resin 8 described above was used as the urethane-modified crystalline polyester resin, Master Batch 8 described above was used as the master batch, Pigment-Wax Dispersion Liquid 9 described below was used as the pigment-wax dispersion liquid, Emulsified Slurry 9 described below was used as the emulsified slurry, Dispersion Slurry 9 described below was used as the dispersion slurry, Filtration Cake 9 described below was used as the filtration cake, and Toner Base Particles 9 were used as the toner base particles. The properties of the obtained toner are presented in Table 1, and the evaluation results thereof are presented in Table 2.

—Production of Oil Phase—

A vessel equipped with a thermometer and a stirrer was charged with 72 parts by mass of Urethane-Modified Crystalline Polyester Resin 8. To this, ethyl acetate was added in an amount that made the solid content of the mixture 50% by mass, and the resulting mixture was heated to the temperature equal to or higher than the melting point of the resin to sufficiently dissolve the resin. To this, 40 parts by mass of 50% by mass Non-Crystalline Resin 7 ethyl acetate solution, 60 parts by mass of Releasing Agent Dispersion Liquid, and 16 parts of Master Batch 8 were added, and the resulting mixture was stirred by TK Homomixer (manufactured by PRIMIX Corporation) at 5,000 rpm and 50° C., to homogeneously dissolve and disperse the contents, to thereby obtain Pigment-Wax Dispersion Liquid 9. Note that, the temperature of Pigment-Wax Dispersion Liquid 9 in the vessel was maintained at 50° C., and Pigment-Wax Dispersion Liquid 9 was used within 5 hours from the production thereof so as not to be crystallized.

—Production of Toner—

Aqueous Phase 7 (520 parts by mass) was placed into another vessel equipped with a stirrer and a thermometer, and was heated to 40° C. While stirring Aqueous Phase 7 by TK Homomixer (manufactured by PRIMIX Corporation) at 13,000 rpm with maintaining the temperature thereof in the range of 40° C. to 50° C., 260 parts by mass of Pigment-Wax Dispersion Liquid 9 temperature of which had been kept at 50° C. was added thereto, and the mixture was emulsified over 1 minute, to thereby obtain Emulsified Slurry 9.

Subsequently, a vessel equipped with a stirrer and a thermometer was charged with Emulsified Slurry 9, and the solvent therein was removed at 60° C. for 6 hours, to thereby obtain Dispersion Slurry 9. After filtering Dispersion Slurry 9 under the reduced pressure, the following washing treatment was performed.

(1): To the filtration cake, 100 parts by mass of ion-exchanged water was added, and the mixture was mixed (at 6,000 rpm for 5 minutes) by the TK Homomixer, followed by filtering the mixture.

(2): To the filtration cake obtained in (1), 100 parts by mass of a 10% by mass sodium hydroxide aqueous solution was added, and the mixture was mixed (at 6,000 rpm for 10 minutes) by the TK Homomixer, followed by filtering the mixture under the reduced pressure.

(3): To the filtration cake obtained in (2), 100 parts by mass of 10% by mass hydrochloric acid was added, and the mixture was mixed (at 6,000 rpm for 5 minutes) by the TK Homomixer, followed by filtering the mixture.

(4): To the filtration cake obtained in (3), 300 parts by mass of ion-exchanged water was added, and the mixture was mixed (at 6,000 rpm for 5 minutes) by the TK Homomixer, followed by filtering the mixture.

As for the washing treatment, a series of the operations (1) to (4) was performed twice, to thereby obtain Filtration Cake 9. Filtration Cake 9 was dried with an air-circulating drier for 48 hours at 45° C., and was then passed through a sieve with a mesh size of 75 μm, to thereby prepare Toner Base Particles 9. Thereafter, 100 parts by mass of Toner Base Particles 9 and 1 part of hydrophobic silica having a diameter of 13 nm were mixed by HENSCHEL MIXER, to thereby obtain a toner. The properties of the obtained toner are presented in Table 1, and the evaluation results thereof are presented in Table 2.

Example 10

A toner was obtained in the same manner as in Example 7, provided that Urethane-Modified Crystalline Polyester Resin 10 described below was used as the urethane-modified crystalline polyester resin, Master Batch 10 described below was used as the master batch, Pigment-Wax Dispersion Liquid 10 described below was used as the pigment-wax dispersion liquid, Emulsified Slurry 10 described below was used as the emulsified slurry, Dispersion Slurry 10 described below was used as the dispersion slurry, Filtration Cake 10 described below was used as the filtration cake, and Toner Base Particles 10 were used as the toner base particles. The properties of the obtained toner are presented in Table 1, and the evaluation results thereof are presented in Table 2.

—Production of Urethane-Modified Crystalline Polyester Resin—

A reaction vessel equipped with a cooling tube, a stirrer, and a nitrogen-inlet tube was charged with 202 parts by mass (1.00 mol) of sebacic acid, 15 parts by mass (0.10 mol) of adipic acid, 177 parts by mass (1.50 mol) of 1,6-hexanediol, and 0.5 parts by mass of tetrabutoxy titanate serving as a condensation catalyst, and the resulting mixture was allowed to react under a flow of nitrogen gas at 180° C. for 8 hours while removing the generated water.

Next, the mixture was gradually heated to 220° C., while removing the generated water and 1,6-hexanediol under the flow of nitrogen, to thereby react for 4 hours, followed by further reacting under the reduced pressure of 5 mmHg to 20 mmHg until the weight average molecular weight Mw of the reaction product reached about 12,000, to thereby obtain Crystalline Polyester Resin 7'.

Subsequently, Crystalline Polyester Resin 7' was transferred into a reaction vessel equipped with a cooling tube, a stirrer, and a nitrogen-inlet tube. To this, 350 parts by mass of ethyl acetate, and 30 parts by mass (0.12 mol) of 4,4'-diphenylmethane diisocyanate (MDI) were added, and the resulting mixture was allowed to react for 5 hours at 80° C. under a flow of nitrogen. Next, the ethyl acetate was removed under the reduced pressure, to thereby obtain Urethane-Modified Crystalline Polyester Resin 10.

—Production of Master Batch—

| | |
|---|---|
| Urethane-Modified Crystalline Polyester Resin 10 | 100 parts by mass |
| Carbon black (Printex35, manufactured by Evonik Degussa Japan Co., Ltd.) (DBP oil absorption value: 42 mL/100 g, pH: 9.5) | 100 parts by mass |
| Ion-exchanged water | 50 parts by mass |

The above-listed rat materials were mixed by means of HENSCHEL MIXER (manufactured by Nippon Cole & Engineering Co., Ltd.). The obtained mixture was kneaded by a two-roll mill. As for the kneading temperature, the kneading was started at 90° C., followed by gradually cooling to 50° C. The obtained kneaded product was pulverized by a pulverizer (manufactured by Hosokawa Micron Corporation), to thereby produce Master Batch 10.

—Production of Oil Phase—

A vessel equipped with a thermometer and a stirrer was charged with 52 parts by mass of Urethane-Modified Crystalline Polyester Resin 10. To this, ethyl acetate was added in an amount that made the solid content of the mixture 50% by mass, and the resulting mixture was heated to the temperature equal to or higher than the melting point of the resin to sufficiently dissolve the resin. To this, 80 parts by mass of 50% by mass Non-Crystalline Resin 7 ethyl acetate solution, 60 parts by mass of Releasing Agent Dispersion Liquid, and 16 parts of Master Batch 10 were added, and the resulting mixture was stirred by TK Homomixer (manufactured by PRIMIX Corporation) at 5,000 rpm and 50° C., to homogeneously dissolve and disperse the contents, to thereby obtain Pigment-Wax Dispersion Liquid 10. Note that, the temperature of Pigment-Wax Dispersion Liquid 10 in the vessel was maintained at 50° C., and Pigment-Wax Dispersion Liquid 10 was used within 5 hours from the production thereof so as not to be crystallized.

—Production of Toner—

Aqueous Phase 7 (520 parts by mass) was placed into another vessel equipped with a stirrer and a thermometer, and was heated to 40° C. While stirring Aqueous Phase 7 by TK Homomixer (manufactured by PRIMIX Corporation) at 13,000 rpm with maintaining the temperature thereof in the range of 40° C. to 50° C., 260 parts by mass of Pigment-Wax Dispersion Liquid 10 temperature of which had been kept at 50° C. was added thereto, and the mixture was emulsified over 1 minute, to thereby obtain Emulsified Slurry 10. Subsequently, a vessel equipped with a stirrer and a thermometer was charged with Emulsified Slurry 10, and the solvent therein was removed at 60° C. for 6 hours, to thereby obtain Dispersion Slurry 10. After filtering Dispersion Slurry 10 under the reduced pressure, the following washing treatment was performed.

(1): To the filtration cake, 100 parts by mass of ion-exchanged water was added, and the mixture was mixed (at 6,000 rpm for 5 minutes) by the TK Homomixer, followed by filtering the mixture.

(2): To the filtration cake obtained in (1), 100 parts by mass of a 10% by mass sodium hydroxide aqueous solution was added, and the mixture was mixed (at 6,000 rpm for 10 minutes) by the TK Homomixer, followed by filtering the mixture under the reduced pressure.

(3): To the filtration cake obtained in (2), 100 parts by mass of 10% by mass hydrochloric acid was added, and the mixture was mixed (at 6,000 rpm for 5 minutes) by the TK Homomixer, followed by filtering the mixture.

(4): To the filtration cake obtained in (3), 300 parts by mass of ion-exchanged water was added, and the mixture was mixed (at 6,000 rpm for 5 minutes) by the TK Homomixer, followed by filtering the mixture.

As for the washing treatment, a series of the operations (1) to (4) was performed twice, to thereby obtain Filtration Cake 10. Filtration Cake 10 was dried with an air-circulating drier for 48 hours at 45° C., and was then passed through a sieve with a mesh size of 75 to thereby prepare Toner Base Particles 10. Thereafter, 100 parts by mass of Toner Base Particles 10 and 1 part of hydrophobic silica having a diameter of 13 nm were mixed by HENSCHEL MIXER, to thereby obtain a toner. The properties of the obtained toner are presented in Table 1, and the evaluation results thereof are presented in Table 2.

Example 11

A toner was obtained in the same manner as in Example 7, provided that Urethane-Modified Crystalline Polyester Resin 10 described above was used as the urethane-modified crystalline polyester resin, Master Batch 10 described above was used as the master batch, Pigment-Wax Dispersion Liquid 11 described below was used as the pigment-wax dispersion liquid, Emulsified Slurry 11 described below was used as the emulsified slurry, Dispersion Slurry 11 described below was used as the dispersion slurry, Filtration Cake 11 described below was used as the filtration cake, and Toner Base Particles 11 were used as the toner base particles. The properties of the obtained toner are presented in Table 1, and the evaluation results thereof are presented in Table 2.

—Production of Oil Phase—

A vessel equipped with a thermometer and a stirrer was charged with 72 parts by mass of Urethane-Modified Crystalline Polyester Resin 10. To this, ethyl acetate was added in an amount that made the solid content of the mixture 50% by mass, and the resulting mixture was heated to the temperature equal to or higher than the melting point of the resin to sufficiently dissolve the resin. To this, 40 parts by mass of 50% by mass Non-Crystalline Resin 7 ethyl acetate solution, 60 parts by mass of Releasing Agent Dispersion Liquid, and 16 parts of Master Batch 10 were added, and the resulting mixture was stirred by TK Homomixer (manufactured by PRIMIX Corporation) at 5,000 rpm and 50° C., to homogeneously dissolve and disperse the contents, to thereby obtain Pigment-Wax Dispersion Liquid 11. Note that, the temperature of Pigment-Wax Dispersion Liquid 11 in the vessel was maintained at 50° C., and Pigment-Wax Dispersion Liquid 11 was used within 5 hours from the production thereof so as not to be crystallized.

—Production of Toner—

Aqueous Phase 7 (520 parts by mass) was placed into another vessel equipped with a stirrer and a thermometer, and was heated to 40° C. While stirring Aqueous Phase 7 by TK Homomixer (manufactured by PRIMIX Corporation) at 13,000 rpm with maintaining the temperature thereof in the range of 40° C. to 50° C., 260 parts by mass of Pigment-Wax Dispersion Liquid 11 temperature of which had been kept at 50° C. was added thereto, and the mixture was emulsified over 1 minute, to thereby obtain Emulsified Slurry 11.

Subsequently, a vessel equipped with a stirrer and a thermometer was charged with Emulsified Slurry 11, and the solvent therein was removed at 60° C. for 6 hours, to thereby obtain Dispersion Slurry 11. After filtering Dispersion Slurry 11 under the reduced pressure, the following washing treatment was performed.

(1): To the filtration cake, 100 parts by mass of ion-exchanged water was added, and the mixture was mixed (at 6,000 rpm for 5 minutes) by the TK Homomixer, followed by filtering the mixture.

(2): To the filtration cake obtained in (1), 100 parts by mass of a 10% by mass sodium hydroxide aqueous solution was added, and the mixture was mixed (at 6,000 rpm for 10 minutes) by the TK Homomixer, followed by filtering the mixture under the reduced pressure.

(3): To the filtration cake obtained in (2), 100 parts by mass of 10% by mass hydrochloric acid was added, and the mixture was mixed (at 6,000 rpm for 5 minutes) by the TK Homomixer, followed by filtering the mixture.

(4): To the filtration cake obtained in (3), 300 parts by mass of ion-exchanged water was added, and the mixture was mixed (at 6,000 rpm for 5 minutes) by the TK Homomixer, followed by filtering the mixture.

As for the washing treatment, a series of the operations (1) to (4) was performed twice, to thereby obtain Filtration Cake 11.

Filtration Cake 11 was dried with an air-circulating drier for 48 hours at 45° C., and was then passed through a sieve with a mesh size of 75 to thereby prepare Toner Base Particles 11. Thereafter, 100 parts by mass of Toner Base Particles 11 and 1 part of hydrophobic silica having a diameter of 13 nm were mixed by HENSCHEL MIXER, to thereby obtain a toner. The properties of the obtained toner are presented in Table 1, and the evaluation results thereof are presented in Table 2.

Example 12

A toner was obtained in the same manner as in Example 1, provided that the filtration cake was replaced with the following filtration cake, and the toner base particles are replaced with the following toner base particles. The properties of the obtained toner are presented in Table 1, and the evaluation results thereof are presented in Table 2.

—Washing and Drying—

After filtering 100 parts by mass of Dispersion Slurry 1 under the reduced pressure, the following series of operations (1) to (4) was performed twice, to thereby obtain filtration cake.

(1): To the filtration cake, 100 parts by mass of ion-exchanged water was added, and the mixture was mixed (at 12,000 rpm for 10 minutes) by the TK Homomixer, followed by filtering the mixture.

(2): To the filtration cake obtained in (1), 100 parts by mass of a 30% by mass sodium hydroxide aqueous solution was added, and the mixture was mixed (at 12,000 rpm for 30 minutes) by the TK Homomixer with maintaining the temperature of the mixture at 60° C., followed by filtering the mixture under the reduced pressure.

(3): To the filtration cake obtained in (2), 100 parts by mass of 10% by mass hydrochloric acid was added, and the mixture was mixed (at 12,000 rpm for 10 minutes) by the TK Homomixer, followed by filtering the mixture.

(4): To the filtration cake obtained in (3), 300 parts by mass of ion-exchanged water was added, and the mixture was mixed (at 12,000 rpm for 10 minutes) by the TK Homomixer, followed by filtering the mixture.

The obtained filtration cake was dried with an air-circulating drier for 48 hours at 45° C., and was then passed through a sieve with a mesh size of 75 μm, to thereby prepare toner base particles.

Thereafter, 100 parts by mass of the obtained toner base particles and 1 part of hydrophobic silica having a diameter of 13 nm were mixed by HENSCHEL MIXER, to thereby obtain a toner. The properties of the obtained toner are presented in Table 1, and the evaluation results thereof are presented in Table 2.

Example 13

A toner was obtained in the same manner as in Example 7, provided that the toner base particles were replaced with the following toner base particles. The properties of the obtained toner are presented in Table 1, and the evaluation results thereof are presented in Table 2.

—Production of Toner—

Aqueous Phase 7 (520 parts by mass) was placed into another vessel equipped with a stirrer and a thermometer, and was heated to 40° C. While stirring Aqueous Phase 7 by TK Homomixer (manufactured by PRIMIX Corporation) at 13,000 rpm with maintaining the temperature thereof in the range of 40° C. to 50° C., 260 parts by mass of Pigment-Wax Dispersion Liquid 7 temperature of which had been kept at 50° C. was added thereto, and the mixture was emulsified over 1 minute, to thereby obtain Emulsified Slurry 7.

Subsequently, a vessel equipped with a stirrer and a thermometer was charged with Emulsified Slurry 7, and the solvent therein was removed at 60° C. for 6 hours, to thereby obtain Dispersion Slurry 7. After filtering Dispersion Slurry 7 under the reduced pressure, the following washing treatment was performed.

(1): To the filtration cake, 100 parts by mass of ion-exchanged water was added, and the mixture was mixed (at 6,000 rpm for 5 minutes) by the TK Homomixer, followed by filtering the mixture.

(2): To the filtration cake obtained in (1), 100 parts by mass of a 30% by mass sodium hydroxide aqueous solution was added, and the mixture was mixed (at 6,000 rpm for 10 minutes) by the TK Homomixer, followed by filtering the mixture under the reduced pressure.

(3): To the filtration cake obtained in (2), 100 parts by mass of 10% by mass hydrochloric acid was added, and the mixture was mixed (at 6,000 rpm for 5 minutes) by the TK Homomixer, followed by filtering the mixture.

(4): To the filtration cake obtained in (3), 300 parts by mass of ion-exchanged water was added, and the mixture was mixed (at 6,000 rpm for 5 minutes) by the TK Homomixer, followed by filtering the mixture.

As for the washing treatment, a series of the operations (1) to (4) was performed twice, to thereby obtain Filtration Cake 1. Filtration Cake 1 was dried with an air-circulating drier for 48 hours at 45° C., and was then passed through a sieve with a mesh size of 75 μm, to thereby prepare toner base particles. Thereafter, 100 parts by mass of the obtained toner base particles and 1 part of hydrophobic silica having a diameter of 13 nm were mixed by HENSCHEL MIXER, to thereby obtain a toner. The properties of the obtained toner are presented in Table 1, and the evaluation results thereof are presented in Table 2.

Comparative Example 1

A toner was obtained in the same manner as in Example 1, provided that Raw Material Solution 12 described below was used as the raw material solution, Pigment-Wax Dispersion Liquid 12 described below was used as the pigment-wax dispersion solution, Emulsified Slurry 12 described below was used as the emulsified slurry, Dispersion Slurry 12 described below was used as the dispersion slurry, Filtration Cake 12 described below was used as the filtration cake, and Toner Base Particles 12 described below were used as the toner base particles. The properties of the obtained toner are presented in Table 1, and the evaluation results thereof are presented in Table 2.

—Preparation of Oil Phase—

A vessel equipped with a stirring bar and a thermometer was charged with 900 parts by mass of Non-Crystalline Low-Molecular Polyester 1, 120 parts by mass of paraffin wax (melting point: 90° C.), 296 parts by mass of Crystalline Polyester 1, and 1,894 parts by mass of ethyl acetate, and the resulting mixture was heated to 80° C. with stirring. The temperature was kept at 80° C. for 5 hours, followed by cooling the mixture to 30° C. over 1 hour. Next, the vessel was further charged with 250 parts by mass of carbon black (Printex35, manufactured by Evonik Degussa Japan Co., Ltd.) [DBP oil absorption value=42 ml/100 mg, pH=9.5], and 1,000 parts by mass of ethyl acetate, and the resulting mixture was mixed for 1 hour, to thereby obtain Raw Material Solution 12.

Raw Material Solution 12 (1,324 parts by mass) was transferred to another vessel, and the carbon black and wax therein were dispersed by means of a bead mill (ULTRA VISCOMILL, manufactured by AIMEX CO., Ltd.) under the conditions: a liquid feed rate of 1 kg/hr, disk circumferential velocity of 6 m/sec, 0.5 mm-zirconia beads packed to 80% by volume, and 5 passes, to thereby obtain Pigment-Wax Dispersion Liquid 12.

—Emulsification and Removal of Solvent—

A vessel was charged with 749 parts by mass of Pigment-Wax Dispersion Liquid 12, 130 parts by mass of Prepolymer 1, and 3.8 parts by mass of Ketimine Compound 1, and the resulting mixture was mixed by TK Homomixer (manufactured by PRIMIX Corporation) at 5,000 rpm for 5 minutes. To the vessel, 1,200 parts by mass of Aqueous Phase 1 was added, and the resulting mixture was mixed by TK Homomixer at 10,000 rpm for 1.5 hours, to thereby obtain Emulsified Slurry 12.

A vessel equipped with a stirrer and a thermometer was charged with Emulsified Slurry 12, and the solvent therein was removed at 30° C. for 8 hours, followed by maturing at 40° C. for 72 hours, to thereby obtain Dispersion Slurry 12.

—Washing and Drying—

After filtering 100 parts by mass of Dispersion Slurry 12 under the reduced pressure, the following series of operations (1) to (4) was performed twice, to thereby obtain Filtration Cake 12.

(1): To the filtration cake, 100 parts by mass of ion-exchanged water was added, and the mixture was mixed (at 12,000 rpm for 10 minutes) by the TK Homomixer, followed by filtering the mixture.

(2): To the filtration cake obtained in (1), 100 parts by mass of a 10% by mass sodium hydroxide aqueous solution was added, and the mixture was mixed (at 12,000 rpm for 30 minutes) by the TK Homomixer, followed by filtering the mixture under the reduced pressure.

(3): To the filtration cake obtained in (2), 100 parts by mass of 10% by mass hydrochloric acid was added, and the mixture was mixed (at 12,000 rpm for 10 minutes) by the TK Homomixer, followed by filtering the mixture.

(4): To the filtration cake obtained in (3), 300 parts by mass of ion-exchanged water was added, and the mixture was mixed (at 12,000 rpm for 10 minutes) by the TK Homomixer, followed by filtering the mixture.

Filtration Cake 12 was dried with an air-circulating drier for 48 hours at 45° C., and was then passed through a sieve with a mesh size of 75 μm, to thereby prepare Toner Base Particles 12.

Thereafter, 100 parts by mass of Toner Base Particles 12 and 1 part of hydrophobic silica having a diameter of 13 nm were mixed by HENSCHEL MIXER, to thereby obtain a toner. The properties of the obtained toner are presented in Table 1, and the evaluation results thereof are presented in Table 2.

Comparative Example 2

A toner was obtained in the same manner as in Example 1, provided that Raw Material Solution 12 described above was used as the raw material solution, Pigment-Wax Dispersion Liquid 12 described above was used as the pigment-wax dispersion solution, Emulsified Slurry 13 described below was used as the emulsified slurry, Dispersion Slurry 13 described below was used as the dispersion slurry, Filtration Cake 13 described below was used as the filtration cake, and Toner Base Particles 13 described below were used as the toner base particles. The properties of the obtained toner are presented in Table 1, and the evaluation results thereof are presented in Table 2.

—Emulsification and Removal of Solvent—

A vessel was charged with 749 parts by mass of Pigment-Wax Dispersion Liquid 12, 110 parts by mass of Prepolymer 1, and 3.2 parts by mass of Ketimine Compound 1, and the resulting mixture was mixed by TK Homomixer (manufactured by PRIMIX Corporation) at 5,000 rpm for 5 minutes. To the vessel, 1,200 parts by mass of Aqueous Phase 1 was added, and the resulting mixture was mixed by TK Homomixer at 10,000 rpm for 1.5 hours, to thereby obtain Emulsified Slurry 13.

A vessel equipped with a stirrer and a thermometer was charged with Emulsified Slurry 13, and the solvent therein was removed at 30° C. for 8 hours, followed by maturing at 40° C. for 72 hours, to thereby obtain Dispersion Slurry 13.

—Washing and Drying—

After filtering 100 parts by mass of Dispersion Slurry 13 under the reduced pressure, the following series of operations (1) to (4) was performed twice, to thereby obtain Filtration Cake 13.

(1): To the filtration cake, 100 parts by mass of ion-exchanged water was added, and the mixture was mixed (at 12,000 rpm for 10 minutes) by the TK Homomixer, followed by filtering the mixture.

(2): To the filtration cake obtained in (1), 100 parts by mass of a 10% by mass sodium hydroxide aqueous solution was added, and the mixture was mixed (at 12,000 rpm for 30 minutes) by the TK Homomixer, followed by filtering the mixture under the reduced pressure.

(3): To the filtration cake obtained in (2), 100 parts by mass of 10% by mass hydrochloric acid was added, and the mixture was mixed (at 12,000 rpm for 10 minutes) by the TK Homomixer, followed by filtering the mixture.

(4): To the filtration cake obtained in (3), 300 parts by mass of ion-exchanged water was added, and the mixture was mixed (at 12,000 rpm for 10 minutes) by the TK Homomixer, followed by filtering the mixture.

Filtration Cake 13 was dried with an air-circulating drier for 48 hours at 45° C., and was then passed through a sieve with a mesh size of 75 μm, to thereby prepare Toner Base Particles 13.

Thereafter, 100 parts by mass of Toner Base Particles 13 and 1 part of hydrophobic silica having a diameter of 13 nm were mixed by HENSCHEL MIXER, to thereby obtain a toner. The properties of the obtained toner are presented in Table 1, and the evaluation results thereof are presented in Table 2.

Comparative Example 3

A toner was obtained in the same manner as in Example 1, provided that Raw Material Solution 14 described below was used as the raw material solution, Pigment-Wax Dispersion Liquid 14 described below was used as the pigment-wax dispersion solution, Emulsified Slurry 14 described below was used as the emulsified slurry, Dispersion Slurry 14 described below was used as the dispersion slurry, Filtration Cake 14 described below was used as the filtration cake, and Toner Base Particles 14 described below were used as the toner base particles. The properties of the obtained toner are presented in Table 1, and the evaluation results thereof are presented in Table 2.

—Preparation of Oil Phase—

A vessel equipped with a stirring bar and a thermometer was charged with 700 parts by mass of Non-Crystalline Low-Molecular Polyester 1, 120 parts by mass of paraffin wax (melting point: 90° C.), 496 parts by mass of Crystalline Polyester 1, and 1,894 parts by mass of ethyl acetate, and the resulting mixture was heated to 80° C. with stirring. The temperature was kept at 80° C. for 5 hours, followed by cooling the mixture to 30° C. over 1 hour. Next, the vessel was further charged with 250 parts by mass of carbon black (Printex35, manufactured by Evonik Degussa Japan Co., Ltd.) [DBP oil absorption value=42 ml/100 mg, pH=9.5], and 1,000 parts by mass of ethyl acetate, and the resulting mixture was mixed for 1 hour, to thereby obtain Raw Material Solution 14.

Raw Material Solution 14 (1,324 parts by mass) was transferred to another vessel, and the carbon black and wax therein were dispersed by means of a bead mill (ULTRA VISCOMILL, manufactured by AIMEX CO., Ltd.) under the conditions: a liquid feed rate of 1 kg/hr, disk circumferential velocity of 6 m/sec, 0.5 mm-zirconia beads packed to 80% by volume, and 5 passes, to thereby obtain Pigment-Wax Dispersion Liquid 14.

—Emulsification and Removal of Solvent—

A vessel was charged with 749 parts by mass of Pigment-Wax Dispersion Liquid 14, 100 parts by mass of Prepolymer 1, and 2.9 parts by mass of Ketimine Compound 1, and the resulting mixture was mixed by TK Homomixer (manufactured by PRIMIX Corporation) at 5,000 rpm for 5 minutes. To the vessel, 1,200 parts by mass of Aqueous Phase 1 was added, and the resulting mixture was mixed by TK Homomixer at 10,000 rpm for 1.5 hours, to thereby obtain Emulsified Slurry 14.

A vessel equipped with a stirrer and a thermometer was charged with Emulsified Slurry 14, and the solvent therein was removed at 30° C. for 8 hours, followed by maturing at 40° C. for 72 hours, to thereby obtain Dispersion Slurry 14.

—Washing and Drying—

After filtering 100 parts by mass of Dispersion Slurry 14 under the reduced pressure, the following series of operations (1) to (4) was performed twice, to thereby obtain Filtration Cake 14.

(1): To the filtration cake, 100 parts by mass of ion-exchanged water was added, and the mixture was mixed (at 12,000 rpm for 10 minutes) by the TK Homomixer, followed by filtering the mixture.

(2): To the filtration cake obtained in (1), 100 parts by mass of a 10% by mass sodium hydroxide aqueous solution was added, and the mixture was mixed (at 12,000 rpm for 30 minutes) by the TK Homomixer, followed by filtering the mixture under the reduced pressure.

(3): To the filtration cake obtained in (2), 100 parts by mass of 10% by mass hydrochloric acid was added, and the mixture was mixed (at 12,000 rpm for 10 minutes) by the TK Homomixer, followed by filtering the mixture.

(4): To the filtration cake obtained in (3), 300 parts by mass of ion-exchanged water was added, and the mixture was mixed (at 12,000 rpm for 10 minutes) by the TK Homomixer, followed by filtering the mixture.

Filtration Cake 14 was dried with an air-circulating drier for 48 hours at 45° C., and was then passed through a sieve with a mesh size of 75 to thereby prepare Toner Base Particles 14.

Thereafter, 100 parts by mass of Toner Base Particles 14 and 1 part of hydrophobic silica having a diameter of 13 nm were mixed by HENSCHEL MIXER, to thereby obtain a toner. The properties of the obtained toner are presented in Table 1, and the evaluation results thereof are presented in Table 2.

Comparative Example 4

A toner was obtained in the same manner as in Example 7, provided that Urethane-Modified Crystalline Polyester Resin 15 described below was used as the urethane-modified crystalline polyester resin, Master Batch 15 described below was used as the master batch, Pigment-Wax Dispersion Liquid 15 described below was used as the pigment-wax dispersion liquid, Emulsified Slurry 15 described below was used as the emulsified slurry, Dispersion Slurry 15 described below was used as the dispersion slurry, Filtration Cake 15 described below was used as the filtration cake, and Toner Base Particles 15 were used as the toner base particles. The properties of the obtained toner are presented in Table 1, and the evaluation results thereof are presented in Table 2.

—Production of Urethane-Modified Crystalline Polyester Resin—

A reaction vessel equipped with a cooling tube, a stirrer, and a nitrogen-inlet tube was charged with 202 parts by mass (1.00 mol) of sebacic acid, 15 parts by mass (0.10 mol) of adipic acid, 177 parts by mass (1.50 mol) of 1,6-hexanediol, and 0.5 parts by mass of tetrabutoxy titanate serving as a condensation catalyst, and the resulting mixture was allowed to react under a flow of nitrogen gas at 180° C. for 8 hours while removing the generated water.

Next, the mixture was gradually heated to 220° C., while removing the generated water and 1,6-hexanediol under the flow of nitrogen, to thereby react for 4 hours, followed by further reacting under the reduced pressure of 5 mmHg to 20 mmHg until the weight average molecular weight Mw of the reaction product reached about 12,000, to thereby obtain Crystalline Polyester Resin 7'. Crystalline Polyester Resin 7' had the weight average molecular weight Mw of 12,000.

Subsequently, Crystalline Polyester Resin 7' was transferred into a reaction vessel equipped with a cooling tube, a stirrer, and a nitrogen-inlet tube. To this, 350 parts by mass of ethyl acetate, and 25 parts by mass (0.10 mol) of 4,4'-diphenylmethane diisocyanate (MDI) were added, and the resulting mixture was allowed to react for 5 hours at 80° C. under a flow of nitrogen. Next, the ethyl acetate was removed under the reduced pressure, to thereby obtain Urethane-Modified Crystalline Polyester Resin 15.

—Production of Master Batch—

| | |
|---|---|
| Urethane-Modified Crystalline Polyester Resin 15 | 100 parts by mass |
| Carbon black (Printex35, manufactured by Evonik Degussa Japan Co., Ltd.) (DBP oil absorption value: 42 mL/100 g, pH: 9.5) | 100 parts by mass |
| Ion-exchanged water | 50 parts by mass |

The above-listed rat materials were mixed by means of HENSCHEL MIXER (manufactured by Nippon Cole & Engineering Co., Ltd.). The obtained mixture was kneaded by a two-roll mill. As for the kneading temperature, the kneading was started at 90° C., followed by gradually cooling to 50° C. The obtained kneaded product was pulverized by a pulverizer (manufactured by Hosokawa Micron Corporation), to thereby produce Master Batch 15.

—Production of Oil Phase—

A vessel equipped with a thermometer and a stirrer was charged with 72 parts by mass of Urethane-Modified Crystalline Polyester Resin 15. To this, ethyl acetate was added in an amount that made the solid content of the mixture 50% by mass, and the resulting mixture was heated to the temperature equal to or higher than the melting point of the resin to sufficiently dissolve the resin. To this, 40 parts by mass of 50% by mass Non-Crystalline Resin 7 ethyl acetate solution, 60 parts by mass of Releasing Agent Dispersion Liquid, and 16 parts of Master Batch 15 were added, and the resulting mixture was stirred by TK Homomixer (manufactured by PRIMIX Corporation) at 5,000 rpm and 50° C., to homogeneously dissolve and disperse the contents, to thereby obtain Pigment-Wax Dispersion Liquid 15. Note that, the temperature of Pigment-Wax Dispersion Liquid 15 in the vessel was maintained at 50° C., and Pigment-Wax Dispersion Liquid 15 was used within 5 hours from the production thereof so as not to be crystallized.

—Production of Toner—

Aqueous Phase 7 (520 parts by mass) was placed into another vessel equipped with a stirrer and a thermometer, and was heated to 40° C. While stirring Aqueous Phase 7 by TK Homomixer (manufactured by PRIMIX Corporation) at 13,000 rpm with maintaining the temperature thereof in the range of 40° C. to 50° C., 260 parts by mass of Pigment-Wax Dispersion Liquid 15 temperature of which had been kept at 50° C. was added thereto, and the mixture was emulsified over 1 minute, to thereby obtain Emulsified Slurry 15.

Subsequently, a vessel equipped with a stirrer and a thermometer was charged with Emulsified Slurry 15, and the solvent therein was removed at 60° C. for 6 hours, to thereby obtain Dispersion Slurry 15. After filtering Dispersion Slurry 15 under the reduced pressure, the following washing treatment was performed.

(1): To the filtration cake, 100 parts by mass of ion-exchanged water was added, and the mixture was mixed (at 6,000 rpm for 5 minutes) by the TK Homomixer, followed by filtering the mixture.

(2): To the filtration cake obtained in (1), 100 parts by mass of a 10% by mass sodium hydroxide aqueous solution was added, and the mixture was mixed (at 6,000 rpm for 10 minutes) by the TK Homomixer, followed by filtering the mixture under the reduced pressure.

(3): To the filtration cake obtained in (2), 100 parts by mass of 10% by mass hydrochloric acid was added, and the mixture was mixed (at 6,000 rpm for 5 minutes) by the TK Homomixer, followed by filtering the mixture.

(4): To the filtration cake obtained in (3), 300 parts by mass of ion-exchanged water was added, and the mixture was mixed (at 6,000 rpm for 5 minutes) by the TK Homomixer, followed by filtering the mixture.

As for the washing treatment, a series of the operations (1) to (4) was performed twice, to thereby obtain Filtration Cake 15. Filtration Cake 15 was dried with an air-circulating drier for 48 hours at 45° C., and was then passed through a sieve with a mesh size of 75 μm, to thereby prepare Toner Base Particles 15. Thereafter, 100 parts by mass of Toner Base Particles 15 and 1 part of hydrophobic silica having a diameter of 13 nm were mixed by HENSCHEL MIXER, to thereby obtain a toner. The properties of the obtained toner are presented in Table 1, and the evaluation results thereof are presented in Table 2.

Comparative Example 5

A toner was obtained in the same manner as in Example 7, provided that Urethane-Modified Crystalline Polyester Resin 10 described above was used as the urethane-modified crystalline polyester resin, Master Batch 10 described above was used as the master batch, Pigment-Wax Dispersion Liquid 16 described below was used as the pigment-wax dispersion liquid, Emulsified Slurry 16 described below was used as the emulsified slurry, Dispersion Slurry 16 described below was used as the dispersion slurry, Filtration Cake 16 described below was used as the filtration cake, and Toner Base Particles 16 were used as the toner base particles. The properties of the obtained toner are presented in Table 1, and the evaluation results thereof are presented in Table 2.

—Production of Oil Phase—

A vessel equipped with a thermometer and a stirrer was charged with 82 parts by mass of Urethane-Modified Crystalline Polyester Resin 10. To this, ethyl acetate was added in an amount that made the solid content of the mixture 50% by mass, and the resulting mixture was heated to the temperature equal to or higher than the melting point of the resin to sufficiently dissolve the resin. To this, 20 parts by mass of 50% by mass Non-Crystalline Resin 7 ethyl acetate solution, 60 parts by mass of Releasing Agent Dispersion Liquid, and 16 parts of Master Batch 10 were added, and the resulting mixture was stirred by TK Homomixer (manufactured by PRIMIX Corporation) at 5,000 rpm and 50° C., to homogeneously dissolve and disperse the contents, to thereby obtain Pigment-Wax Dispersion Liquid 16. Note that, the temperature of Pigment-Wax Dispersion Liquid 16 in the vessel was maintained at 50° C., and Pigment-Wax Dispersion Liquid 16 was used within 5 hours from the production thereof so as not to be crystallized.

—Production of Toner—

Aqueous Phase 7 (520 parts by mass) was placed into another vessel equipped with a stirrer and a thermometer, and was heated to 40° C. While stirring Aqueous Phase 7 by TK Homomixer (manufactured by PRIMIX Corporation) at 13,000 rpm with maintaining the temperature thereof in the range of 40° C. to 50° C., 260 parts by mass of Pigment-Wax Dispersion Liquid 16 temperature of which had been kept at 50° C. was added thereto, and the mixture was emulsified over 1 minute, to thereby obtain Emulsified Slurry 16. Subsequently, a vessel equipped with a stirrer and a thermometer was charged with Emulsified Slurry 16, and the solvent therein was removed at 60° C. for 6 hours, to thereby obtain Dispersion Slurry 16. After filtering Dispersion Slurry 16 under the reduced pressure, the following washing treatment was performed.

(1): To the filtration cake, 100 parts by mass of ion-exchanged water was added, and the mixture was mixed (at 6,000 rpm for 5 minutes) by the TK Homomixer, followed by filtering the mixture.

(2): To the filtration cake obtained in (1), 100 parts by mass of a 10% by mass sodium hydroxide aqueous solution was added, and the mixture was mixed (at 6,000 rpm for 10 minutes) by the TK Homomixer, followed by filtering the mixture under the reduced pressure.

(3): To the filtration cake obtained in (2), 100 parts by mass of 10% by mass hydrochloric acid was added, and the mixture was mixed (at 6,000 rpm for 5 minutes) by the TK Homomixer, followed by filtering the mixture.

(4): To the filtration cake obtained in (3), 300 parts by mass of ion-exchanged water was added, and the mixture was mixed (at 6,000 rpm for 5 minutes) by the TK Homomixer, followed by filtering the mixture.

As for the washing treatment, a series of the operations (1) to (4) was performed twice, to thereby obtain Filtration Cake 16.

Filtration Cake 16 was dried with an air-circulating drier for 48 hours at 45° C., and was then passed through a sieve with a mesh size of 75 μM, to thereby prepare Toner Base Particles 16. Thereafter, 100 parts by mass of Toner Base Particles 16 and 1 part of hydrophobic silica having a diameter of 13 nm were mixed by HENSCHEL MIXER, to thereby obtain a toner. The properties of the obtained toner are presented in Table 1, and the evaluation results thereof are presented in Table 2.

Comparative Example 6

A toner was obtained in the same manner as in Example 7, provided that Urethane-Modified Crystalline Polyester Resin 8 described above was used as the urethane-modified crystalline polyester resin, Master Batch 8 described above was used as the master batch, Pigment-Wax Dispersion Liquid 17 described below was used as the pigment-wax dispersion liquid, Emulsified Slurry 17 described below was used as the emulsified slurry, Dispersion Slurry 17 described below was used as the dispersion slurry, Filtration Cake 17 described below was used as the filtration cake, and Toner Base Particles 17 were used as the toner base particles. The properties of the obtained toner are presented in Table 1, and the evaluation results thereof are presented in Table 2.

—Production of Oil Phase—

A vessel equipped with a thermometer and a stirrer was charged with 82 parts by mass of Urethane-Modified Crystalline Polyester Resin 8. To this, ethyl acetate was added in an amount that made the solid content of the mixture 50% by mass, and the resulting mixture was heated to the temperature equal to or higher than the melting point of the resin to sufficiently dissolve the resin. To this, 20 parts by mass of 50% by mass Non-Crystalline Resin 7 ethyl acetate solution, 60 parts by mass of Releasing Agent Dispersion Liquid, and 16 parts of Master Batch 8 were added, and the resulting mixture was stirred by TK Homomixer (manufactured by PRIMIX Corporation) at 5,000 rpm and 50° C., to homogeneously dissolve and disperse the contents, to thereby obtain Pigment-Wax Dispersion Liquid 17. Note that, the temperature of Pigment-Wax Dispersion Liquid 17 in the vessel was maintained at 50° C., and Pigment-Wax Dispersion Liquid 17 was used within 5 hours from the production thereof so as not to be crystallized.

—Production of Toner—

Aqueous Phase 7 (520 parts by mass) was placed into another vessel equipped with a stirrer and a thermometer, and was heated to 40° C. While stirring Aqueous Phase 7 by TK Homomixer (manufactured by PRIMIX Corporation) at 13,000 rpm with maintaining the temperature thereof in the range of 40° C. to 50° C., 260 parts by mass of Pigment-Wax Dispersion Liquid 17 temperature of which had been kept at 50° C. was added thereto, and the mixture was emulsified over 1 minute, to thereby obtain Emulsified Slurry 17.

Subsequently, a vessel equipped with a stirrer and a thermometer was charged with Emulsified Slurry 17, and the solvent therein was removed at 60° C. for 6 hours, to thereby obtain Dispersion Slurry 17. After filtering Dispersion Slurry 17 under the reduced pressure, the following washing treatment was performed.

(1): To the filtration cake, 100 parts by mass of ion-exchanged water was added, and the mixture was mixed (at 6,000 rpm for 5 minutes) by the TK Homomixer, followed by filtering the mixture.

(2): To the filtration cake obtained in (1), 100 parts by mass of a 10% by mass sodium hydroxide aqueous solution was added, and the mixture was mixed (at 6,000 rpm for 10 minutes) by the TK Homomixer, followed by filtering the mixture under the reduced pressure.

(3): To the filtration cake obtained in (2), 100 parts by mass of 10% by mass hydrochloric acid was added, and the mixture was mixed (at 6,000 rpm for 5 minutes) by the TK Homomixer, followed by filtering the mixture.

(4): To the filtration cake obtained in (3), 300 parts by mass of ion-exchanged water was added, and the mixture was mixed (at 6,000 rpm for 5 minutes) by the TK Homomixer, followed by filtering the mixture.

As for the washing treatment, a series of the operations (1) to (4) was performed twice, to thereby obtain Filtration Cake 17. Filtration Cake 17 was dried with an air-circulating drier for 48 hours at 45° C., and was then passed through a sieve with a mesh size of 75 μm, to thereby prepare Toner Base Particles 17. Thereafter, 100 parts by mass of Toner Base Particles 17 and 1 part of hydrophobic silica having a diameter of 13 nm were mixed by HENSCHEL MIXER, to thereby obtain a toner. The properties of the obtained toner are presented in Table 1, and the evaluation results thereof are presented in Table 2.

(Evaluation Items)

1) Evaluation of Low Temperature Fixing Ability

The low temperature fixing ability was evaluated based upon the maximum fixing temperature and the minimum fixing temperature.

On each of transfer sheets, plain paper, and cardboard (Type 6200 manufactured by Ricoh Company Limited, and Photocopy printing sheet <135> manufactured by Ricoh Company Limited), a solid image having a toner deposition amount of 0.85 mg/cm$^2$±0.1 mg/cm$^2$ was formed, and a fixing test was performed with varying temperature of fixing belt. The solid image was formed on the position, which was 3.0 cm away from the edge of the sheet from which the sheet was fed.

The highest temperature at which offset did not occur on the plain paper was determined as the maximum fixing temperature. Moreover, the minimum fixing temperature was determined by scratch drawing the fixed image obtained on the cardboard using a scratch drawing tester with a load of 50 g. The temperature of the fixing roller at which scratches on the image were almost none was determined as the minimum fixing temperature. The evaluation results are presented in Table 2.

Criteria of each evaluation was as follows:

(Maximum Fixing Temperature)

A: 191° C. or higher
B: 190° C. to 181° C.
C: 180° C. to 171° C.
D: 170° C. or lower (Minimum Fixing Temperature)

A: Lower than 120° C.
B: 120° C. to 130° C.
C: 130° C. to 140° C.
D: 140° C. or higher 2) Evaluation of Aggregation The evaluation of aggregation was performed by counting a number of white missing spots formed due to aggregation of the toner. After outputting 10,000 sheets of a 3% image area chart using the obtained two-component developer and the evaluation device (heating temperature of the fixing unit: 150° C.) in a high temperature and high humidity environment, i.e., 35° C., 70% RH, 100,000 sheets of an entire solid image were output, followed by counting the white missing spots formed in the image. Specifically, a fewer number of the white missing spots is the better.

The evaluation criteria was as follows.

A: Significantly excellent
B: Excellent
C: Slightly defective
D: Defective

TABLE 1

| | | | DSC | | | | |
|---|---|---|---|---|---|---|---|
| | Relaxation time of soft component (ms) | Proportion of soft component (%) | T1 (° C.) | T2 (° C.) | T1-T2 (° C.) | Max. endothermic temperature of second heating (° C.) | Amount of melting heat of second heating (J/g) |
| Ex. 1 | 0.21 | 30.2 | 62.4 | 33.1 | 29.3 | 62.0 | 40 |
| Ex. 2 | 0.11 | 5.2 | 62.9 | 33.7 | 29.2 | 61.1 | 35 |
| Ex. 3 | 0.31 | 8.6 | 63.2 | 38.3 | 24.9 | 62.8 | 50 |
| Ex. 4 | 0.11 | 47.7 | 62.5 | 33.3 | 29.2 | 61.1 | 36 |
| Ex. 5 | 0.33 | 40.3 | 63.8 | 39.1 | 24.7 | 60.9 | 49 |
| Ex. 6 | 0.18 | 20.0 | 62.8 | 33.3 | 29.5 | 63.0 | 41 |
| Ex. 7 | 0.39 | 25.0 | 60.3 | 40.0 | 20.3 | 58.0 | 55 |
| Ex. 8 | 0.22 | 10.1 | 59.3 | 34.2 | 25.1 | 58.7 | 50 |
| Ex. 9 | 0.49 | 11.1 | 59.2 | 41.0 | 18.2 | 60.0 | 59 |
| Ex. 10 | 0.29 | 48.2 | 60.8 | 35.7 | 25.1 | 60.1 | 53 |
| Ex. 11 | 0.48 | 49.8 | 60.1 | 40.7 | 19.4 | 58.2 | 60 |
| Ex. 12 | 0.22 | 40.3 | 62.5 | 33.3 | 29.2 | 62.2 | 39 |
| Ex. 13 | 0.39 | 39.7 | 60.3 | 40.9 | 19.4 | 58.3 | 56 |
| Comp. Ex. 1 | 0.08 | 9.3 | 65.5 | 33.2 | 32.3 | 60.2 | 26 |
| Comp. Ex. 2 | 0.08 | 42.7 | 64.7 | 33.4 | 31.3 | 63.2 | 28 |
| Comp. Ex. 3 | 0.16 | 57.3 | 62.8 | 33.4 | 29.4 | 62.8 | 37 |
| Comp. Ex. 4 | 0.46 | 52.0 | 59.9 | 40.0 | 19.9 | 58.1 | 58 |
| Comp. Ex. 5 | 0.56 | 45.3 | 59.2 | 40.7 | 18.5 | 57.9 | 61 |
| Comp. Ex. 6 | 0.51 | 8.7 | 59.2 | 41.1 | 18.1 | 59.9 | 61 |

TABLE 1-continued

| | Presence of core-shell structure | Molecular weight: Proportion of the component having molecular weight of 100,000 or greater | Molecular weight: Mw |
|---|---|---|---|
| Ex. 1 | Present | 7.9 | 35,000 |
| Ex. 2 | Present | 8.1 | 40,000 |
| Ex. 3 | Present | 7.9 | 38,000 |
| Ex. 4 | Present | 7.3 | 30,000 |
| Ex. 5 | Present | 7.2 | 32,000 |
| Ex. 6 | Present | 8.2 | 37,000 |
| Ex. 7 | Present | 6.5 | 35,000 |
| Ex. 8 | Present | 6.2 | 34,000 |
| Ex. 9 | Present | 6.4 | 33,000 |
| Ex. 10 | Present | 5.6 | 30,000 |
| Ex. 11 | Present | 6.2 | 31,000 |
| Ex. 12 | Not present | 7.6 | 34,000 |
| Ex. 13 | Not present | 6.0 | 30,000 |
| Comp. Ex. 1 | Present | 9.6 | 40,000 |
| Comp. Ex. 2 | Present | 7.9 | 40,000 |
| Comp. Ex. 3 | Present | 7.1 | 28,000 |
| Comp. Ex. 4 | Present | 5.3 | 22,000 |
| Comp. Ex. 5 | Present | 6.0 | 30,000 |
| Comp. Ex. 6 | Present | 6.1 | 31,000 |

TABLE 2

| | Low temperature fixing ability: Maximum fixing temperature | Low temperature fixing ability: Minimum fixing temperature | Aggregation in high temperature/high humidity: Formation of white-missing spot |
|---|---|---|---|
| Ex. 1 | B | B | B |
| Ex. 2 | A | C | A |
| Ex. 3 | B | A | A |
| Ex. 4 | A | C | C |
| Ex. 5 | B | A | B |
| Ex. 6 | A | C | A |
| Ex. 7 | B | A | A |
| Ex. 8 | B | B | A |
| Ex. 9 | B | A | A |
| Ex. 10 | B | B | C |
| Ex. 11 | B | A | C |
| Ex. 12 | B | B | C |
| Ex. 13 | B | A | C |
| Comp. Ex. 1 | A | D | A |
| Comp. Ex. 2 | A | D | C |
| Comp. Ex. 3 | A | B | D |
| Comp. Ex. 4 | B | A | D |
| Comp. Ex. 5 | D | A | C |
| Comp. Ex. 6 | D | A | A |

Embodiments of the present invention are, for example, as follows:

<1> A toner, containing:

a colorant;

a resin; and a releasing agent, wherein a spin-spin relaxation time (T2s) originated from a soft component is 0.10 msec to 0.50 msec, where the soft component is obtained with a hard component from an echo signal of the toner by a solid-echo technique of pulsed NMR, and a proportion of a proton intensity of the soft component is 50.0% or lower.

<2> The toner according to <1>, wherein the spin-spin relaxation time (T2s) originated from the soft component is 0.20 msec to 0.50 msec.

<3> The toner according to any of <1> or <2>, wherein the spin-spin relaxation time (T2s) originated from the soft component is 0.30 msec to 0.50 msec.

<4> The toner according to any one of <1> to <3>, wherein the toner satisfies the following relational expressions:

$T1-T2 \leq 30.0°$ C., and, $T2 \geq 30.0°$ C.

where T1 is a maximum endothermic peak obtained from first heating from 0° C. to 100° C. as measured by DSC of the toner, and T2 is a maximum exothermic peak obtained from cooling.

<5> The toner according to any one of <1> to <4>, wherein a maximum endothermic peak temperature obtained from second heating from 0° C. to 100° C. as measured by DSC of the toner falls in a range of 50° C. to 70° C., and an amount of heat of melting in the second heating is 30.0 J/g to 75.0 J/g.

<6> The toner according to any one of <1> to <5>, wherein the toner contains toner particles, and each toner particle has a core-shell structure.

<7> The toner according to any one of <1> to <6>, wherein 5% or more of a tetrahydrofuran (THF) soluble component of the toner has a molecular weight of 100,000 or greater as measured by gel permeation chromatography, and the THF soluble component has a weight average molecular weight (Mw) of 20,000 to 70,000.

<8> The toner according to any one of <1> to <7>, wherein the resin contains a crystalline polyester resin.

<9> The toner according to <8>, wherein the crystalline polyester resin contains a urethane bond, or a urea bond, or a combination thereof.

<10> An image forming apparatus, containing:

a latent electrostatic image bearing member;

a latent electrostatic image forming unit configured to form a latent electrostatic image on the latent electrostatic image bearing member;

a developing unit configured to develop the latent electrostatic image with a toner, to thereby form a visible image;

a transferring unit configured to transfer the visible image onto a recording medium; and a fixing unit configured to fix the visible image on the recording medium with heat and pressure of a fixing member, wherein the image forming apparatus employs a tandem developing system where at least four image forming units each using a different color for developing are tandemly provided, and a system speed thereof is 200 mm/sec to 3,000 mm/sec, wherein contact pressure of the pressing fixing member is 10 N/cm$^2$ to 3,000 N/cm$^2$, and a fixing nip time is 30 msec to 400 msec, and wherein the toner is the toner according to any one of <1> to <9>.

<11> An image forming method, containing:

forming a latent electrostatic image on a latent electrostatic image bearing member;

developing the latent electrostatic image with a toner to form a visible image;

transferring the visible image onto a recording medium; and fixing the visible image on the recording medium with heat and pressure of a fixing member, wherein the image forming method employs a tandem developing system where at least four image forming units each using a different color for developing are tandemly provided, and a system speed thereof is 200 mm/sec to 3,000 mm/sec, wherein contact pressure of the pressing fixing member is 10 N/cm$^2$ to 3,000 N/cm$^2$, and a fixing nip time is 30 msec to 400 msec, and wherein the toner is the toner according to any one of <1> to <9>.

<12> A process cartridge, containing:

a latent electrostatic image bearing member configured to bear a latent electrostatic image thereon; and a developing unit configured to develop the latent electrostatic image on the latent electrostatic image bearing member with a toner, to thereby form a visible image, wherein the toner is the toner according to any one of <1> to <9>.

<13> A two-component developer, containing:

the toner according to any one of <1> to <9>; and a carrier.

Reference Signs List a process cartridge
b photoconductor
c charging unit
d developing unit
e cleaning unit
1 photoconductor
2 primary transfer device
4 intermediate transfer member
5 secondary transfer device
7 fixing device
8 cleaning device
10 intermediate transfer member
18 image forming unit
20 tandem image forming apparatus
21 exposing device
22 secondary transfer device
24 secondary transfer belt
25 fixing device
40 photoconductor
60 charging device
61 developing device
62 primary transfer device
100 photocopier main body

The invention claimed is:

1. A toner comprising toner particles, the toner particles having a core-shell structure and comprising:

a colorant;

a crystalline polyester resin that comprises a urethane bond, or a urea bond, or a combination thereof; and a releasing agent, wherein a spin-spin relaxation time (T2s) originated from a soft component is 0.10 msec to 0.50 msec, where the soft component is obtained with a hard component from an echo signal of the toner particles by a solid-echo technique of pulsed NMR, and a proportion of a proton intensity of the soft component is 50.0% or lower.

2. The toner according to claim 1, wherein the spin-spin relaxation time (T2s) originated from the soft component is 0.20 msec to 0.50 msec.

3. The toner according to claim 1, wherein the spin-spin relaxation time (T2s) originated from the soft component is 0.30 msec to 0.50 msec.

4. The toner according to claim 1, wherein the toner satisfies the following relational expressions:

$$T1-T2\leq 30.0^\circ\text{ C., and, } T2\geq 30.0^\circ\text{ C.}$$

where T1 is a maximum endothermic peak obtained from first heating from 0° C. to 100° C. as measured by DSC of the toner, and T2 is a maximum exothermic peak obtained from cooling.

5. The toner according to claim 1, wherein a maximum endothermic peak temperature obtained from second heating from 0° C. to 100° C. as measured by DSC of the toner falls in a range of 50° C. to 70° C., and an amount of heat of melting in the second heating is 30.0 Jig to 75.0 J/g.

6. The toner according to claim 1, wherein 5% or more of a tetrahydrofuran (THF) soluble component of the toner has a molecular weight of 100,000 or greater as measured by gel permeation chromatography, and the THF soluble component has a weight average molecular weight (Mw) of 20,000 to 70,000.

7. The toner according to claim 1, wherein the crystalline polyester resin comprises a urethane bond.

8. The toner according to claim 7, wherein the crystalline polyester resin comprises a urea bond.

9. An image forming apparatus/toner combination, comprising:

a latent electrostatic image bearing member;

a latent electrostatic image forming unit configured to form a latent electrostatic image on the latent electrostatic image bearing member;

a developing unit comprising the toner according to claim 1 and configured to develop the latent electrostatic image with the toner, to thereby form a visible image;

a transferring unit configured to transfer the visible image onto a recording medium;

a fixing unit configured to fix the visible image on the recording medium with heat and pressure of a fixing member, wherein the image forming apparatus employs a tandem developing system where at least four image forming units each using a different color for developing are tandemly provided, and a system speed thereof is 200 mm/sec to 3,000 mm/sec, and wherein contact pressure of the pressing fixing member is 10 $N/cm^2$ to 3,000 $N/cm^2$, and a fixing nip time is 30 msec to 400 msec.

10. An image forming method, comprising:

forming a latent electrostatic image on a latent electrostatic image bearing member;

developing the latent electrostatic image with a toner to form a visible image;

transferring the visible image onto a recording medium; and fixing the visible image on the recording medium with heat and pressure of a fixing member, wherein the image forming method employs a tandem developing system where at least four image forming units each using a different color for developing are tandemly provided, and a system speed thereof is 200 mm/sec to 3,000 mm/sec, wherein contact pressure of the pressing fixing member is 10 $N/cm^2$ to 3,000 $N/cm^2$, and a fixing nip time is 30 msec to 400 msec, and wherein the toner is the toner according to claim 1.

11. A process cartridge/toner combination, comprising:

a latent electrostatic image bearing member configured to bear a latent electrostatic image thereon; and a developing unit comprising the toner according to claim 1 and configured to develop the latent electrostatic image on the latent electrostatic image bearing member with a toner, to thereby form a visible image.

12. A two-component developer, comprising:

the toner according to claim 1; and a carrier.

* * * * *